US005203841A

United States Patent [19]

Kitabayashi

[11] Patent Number: 5,203,841

[45] Date of Patent: Apr. 20, 1993

[54] DISPENSING HEAD HAVING A CAP GUARD

[76] Inventor: Seiichi Kitabayashi, 919-12, Oaza-Koshikiya, Ageo-shi, Saitama 362, Japan

[21] Appl. No.: 169,198

[22] PCT Filed: Apr. 25, 1987

[86] PCT No.: PCT/JP87/00267

§ 371 Date: Jun. 8, 1990

§ 102(e) Date: Jun. 8, 1990

[87] PCT Pub. No.: WO87/06503

PCT Pub. Date: Nov. 5, 1987

[30] Foreign Application Priority Data

Apr. 25, 1986 [JP] Japan ..... 61-61864
Oct. 3, 1986 [JP] Japan ..... 61-151456
Jan. 21, 1987 [JP] Japan ..... 62-7100

[51] Int. Cl.[5] ..... B65D 83/00

[52] U.S. Cl. ..... 222/402.11; 222/507; 222/530; 222/534; 222/538

[58] Field of Search ..... 222/402.11, 507, 530, 222/538, 556, 182, 534

[56] References Cited

U.S. PATENT DOCUMENTS

| | | | |
|---|---|---|---|
| 3,094,255 | 6/1963 | Hunter | 222/507 |
| 3,278,095 | 10/1966 | Johns | 222/507 |
| 3,358,890 | 12/1967 | Dalpo | 222/507 |
| 3,371,827 | 3/1968 | Micallef | 222/507 |
| 3,386,631 | 6/1968 | Kotuby | 222/402.11 |
| 3,847,313 | 11/1974 | Micallef | 222/507 |
| 4,096,974 | 6/1978 | Haber et al. | 222/530 |

*Primary Examiner*—Gregory L. Huson
*Attorney, Agent, or Firm*—William A. Drucker

[57] ABSTRACT

A guard device for exposed acting portions of aerosol dispensing containers. The nozzle, which projects out of a cap upon use is taken in and all of the acting portions containing the nozzle are closed, making operation impossible to provide protection against pollution and external forces.

8 Claims, 25 Drawing Sheets

DISPENSING HEAD HAVING A CAP GUARD

BACKGROUND OF THE INVENTION

1. Field of the Invention

This invention relates to guard means for exposed acting portions in an aerosol dispenser for dispensing, by means of finger pressure, solution or the like contained in a pressure container under pressure of an expellent.

2. Brief Description of the Prior Art

Active portions of the foregoing aerosol dispenser comprises a dispensing valve portion which exists within a container, a hollow valve stem exposed externally from the container and mechanically connected to the dispensing valve portion, a push button for acting pressure to the valve stem, a nozzle extending externally from the push button for dispensing the solution or the like through a dispensing passage in the push button. These active portions provide a dispensing head.

Such a dispensing head of an aerosol dispenser is not only often subjected to the problem of dirty materials sticking thereto in an unclean environment and entry of dirt and filth, particularly into the nozzle orifice, but is subjected eventually to emission of the solution upon the active portion falling or receiving external forces in transport. In order to prevent these drawbacks, a cup-like guard cap is ordinarily attached to the container to cover the whole head portions containing the dispensing head of the container. However, such a guard cap heretofore used may be eventually be lost by failure to recap after use of the aerosol dispenser.

In recent years, guard means of the dispensing head called one-touch caps have been developed. This one-touch cap generally has an open top face or at least is a cylindrical body having an opening at the top face, which cylindrical body is provided with a window bore at a portion of the cylindrical wall. Upon fixing the skirt of the cylindrical wall to the top portion of a dispensing container and pressing the push button with a finger through the top face opening portion, the solution is dispensed through the window bore.

By means of such one-touch cap, the dispensing head is protected from external forces and, different from the foregoing cup-like cap, it is convenient because removal and reattaching of the cap after every use is not required. However, it is impotent against external forces from above and also it is defenseless against pollution on each portion of the dispensing head because the exterior and the interior of the cap are communicated through the top face opening and the window bore of the cylindrical wall.

Accordingly, it is an object of this invention to remove the drawbacks of the foregoing prior art.

SUMMARY OF THE INVENTION

This invention will be explained with reference to embodiments as shown in the drawings. A dispensing head according to this invention comprises a non-rotary member 1, a rotary member 2, a push button 3, a nozzle tube 4 and a push lid 5.

Non-rotary member 1 has a cylindrical wall 11 supported non-rotatably by a dispensing container K, and cylindrical wall 11 is provided with a wide notch 12 at the front portion thereof.

Rotary member 2 has a cylindrical wall 21 provided co-axially with the cylindrical wall 11 of non-rotary member This cylindrical wall 21 is provided with a window bore 22 which has a size comparable with the diameter of nozzle tube 4 and is supported, manually rotatably in contact with the outer face of cylindrical wall 11 of the non-rotary member by dispensing container K. This rotary member 2 has a range of rotation which extends from an operative position at which window bore 22 is located at position A within notch portion 12 of cylindrical wall 11 of the non-rotary member and in front of push button 3 to a non-operative position at which window bore 22 is located at position B within an angular range of the solid portion of cylindrical wall 21 of the non-rotary member.

Push button 3 is provided with a dispensing passage 31 which is connected to the axial bore of valve stem K1 which projects from the top wall of dispensing container K. Push button 3 is fixedly mounted to valve stem K1 and is non-rotatably supported by dispensing container K.

The nozzle tube is straight but bendable and can be restraightened. It is supported at its base portion by push button 3 and is connected to dispensing passage 31 of the push button. Also, nozzle tube 4 has a nozzle length 1, as measured from the center of push button 3, which is longer than the radius of rotary member 2.

Push lid 5 substantially closes the top portion of rotary member 2 and is supported by push button 3, interlockable therewith at the foregoing operative position.

According to the invention, either one of the non-rotary member 1 or rotary member 2 forms a key member and the other forms a keyhole portion for engaging the key member. By means of the key member and the keyhole portion, means for impeding interlocking of push button 3 and push lid 5 are formed at the non-operative position.

In this specification, however, a "non-rotary member" means a member which has a non-rotatable relation in a horizontal plane with the foregoing dispensing container K. It may be fixed to dispensing container K, but there may be a case in which even if it is not rotatable in a horizontal plane, it is movable in a vertical direction. As seen from embodiments of this invention described hereunder, the non-rotary member comprises various modes in cylindrical or semi-cylindrical shapes. In cases in which it is formed in one body with a member having a concept other than the non-rotary member, the latter member is treated as a portion of the non-rotary member. In this specification, a "rotary member" means a member which has a coaxially rotatable relation with the "non-rotary member".

Further, in this specification, a "key member" may be a member which consists of a projection, a plate, a bar, or a modification of such bodies, and a "keyhole portion" means a portion such as a notch, a groove, a bore or the like having a form or a structure adapted to the "key member" and capable of receiving the same totally at a particular position of the "key member".

The operation of the present invention is explained using FIGS. 1 to 4 in which there is illustrated a first embodiment of this invention as follows: a dispensing head having guard cap means according to this invention has a non-rotary member 1, a rotary member 2, a push button 3, a nozzle tube 4 and a push lid 5. In FIGS. 1 and 2 this is illustrated in an operative position in which is located window bore 22 of rotary member 2 at location A in front of push button 3 and within an angular range of notch 12 of cylindrical wall 11 of the non-rotary member 1. Because nozzle tube 4, as illustrated, is supported at its base portion by the front portion of push button 3 and has a nozzle length 1, as measured from the center of push button 3, which is longer than the radius of rotary member 2, and because the size of window bore 22 of rotary member 2 is comparable with the diameter of nozzle tube 4, nozzle tube 4 projects externally through notch portion 12 of the non-rotary member and window bore 22 at the foregoing operative position.

Push button 3 is fixedly mounted to valved stem K1 as stated in the foregoing and is non-rotatably supported by dispensing container K. Further, non-rotatable supporting means of push button 3 of the first embodiment is formed by guide bars 32 which project from the inner face of non-rotary member 1. However, other non-rotatable supporting means are adopted in other embodiments as described hereinafter.

According to the present invention, push lid 5 substantially closes the top portion of rotary member 2 as illustrated and is supported, interlockably with push button 3, at the foregoing operative position. However, it will be understood from FIG. 1 or FIG. 3 that push lid 5 in the first embodiment is supported by non-rotary member 1.

Accordingly, upon pushing push lid 5 with a finger, push button 3 moves downwardly and valve stem K1 is pushed down. The dispensing valve which is located within dispensing container K opens and the solution contained in the dispensing container K is emitted from nozzle tube 4 through dispensing passage 31.

As mentioned in the foregoing, according to the present invention, nozzle tube 4 is originally straight but can be bent and restored to the original state. In the first embodiment, nozzle tube 4 is pivoted at the front portion of push button 3.

Then, upon rotating rotary member 2 along the arrow as indicated in FIG. 2, nozzle tube 4 is bent under pressure of a side edge of window bore 22 of rotary member 2 and the nozzle end portion 41 is taken in finally within the cylindrical wall 21 of the rotary member 2 as shown in FIG. 4. Because rotary member 2, as stated above, has a rotation range extending from the foregoing operative position in which window bore 22 is located within an angular range of notch portion 12 of non-rotary member 1 to the foregoing non-operative position in which it is located at position B within an angular range of the solid portion of cylindrical wall 11 of non-rotary member 1, upon rotation of the rotary member to the foregoing non-operative position, as shown in FIG. 4, window bore 22 is closed by cylindrical wall 11 of non-rotary member 1, and communication between the interior and the exterior of the rotary member becomes intercepted.

In such a state in which communication is intercepted between the interior and the exterior of the rotary member, there is no danger that filth such as powdery dirt or the like will enter the orifice of nozzle tube 4 or push button 3 and other movable portions.

As stated in the foregoing, push lid 5, at the operative position, is interlockably supported with push button 3. Also, according to the invention, because one of non-rotary member 1 and rotary member 2 is provided with a key member and the other is provided with a keyhole portion adapted to the key member, a check means for the interlocking of push lid 5 and push button 3 at the non-operative position is formed, and push lid 5 and push button 3 will not move interlockably upon pushing lid 5 at the non-operative position. No dispensing of the solution from dispensing container K will be effected.

Further, according to the first embodiment of the invention, by means of grooves 14, each of which is formed between a pair of vertical lamellas (one lamella at one location is seen in FIGS. 1 and 3) projecting inwardly from rotary member 2 and vertical lamellas 51, each of which projecting outwardly from push lid 5, rotary member 2 and push lid 5 engage non-rotatably. By means of vertical lamellas 51, each forming the foregoing key member and notches **15*a* formed on the top edge 15 of cylindrical wall 11 of the non-rotary member and forming the foregoing keyhole portion, interlocking of push lid 5 and push button 3 is possible at the operative position as shown in FIG. 1, and the interlocking is intercepted at the non-operative position as shown in FIG. 3, because, at this latter position, vertical lamellas, each forming the foregoing key member, ride on the top edge 15 of cylindrical wall 11** at the latter position.

According to the invention, because nozzle tube 4 is restorable to its straight mode in the course of recovering of rotary member 2 to the operative position along the arrow as shown in FIG. 4, upon window bore 22 passing nozzle end portion 41 of nozzle tube 4 which is bent, nozzle tube 4 enters into window bore 22 by its restorative force for recovering its straight mode, and returns to the original state as shown in FIG. 2 together with release of the foregoing interlocking impeding means. Thus, emission of the solution upon pushing push lid 5 is made possible.

Further, according to the first embodiment of this invention, the restorative force of nozzle tube 4 to its straight mode is caused by a spring plate 33 molded in one body with push button 3 out of a resilient plastic material.

BRIEF DESCRIPTION OF THE DRAWINGS

FIG. 19(*b*) is a vertical cross-sectional view of the main portion of a modified nozzle tube of the same;

DESCRIPTION OF THE PREFERRED EMBODIMENTS

For better comprehension of this invention, the thirteen embodiments will now be discussed. However, the first embodiment as shown in FIGS. 1 to 4 has been explained in the foregoing description, and the explanation of the same will be eliminated hereunder.

Figure 1:
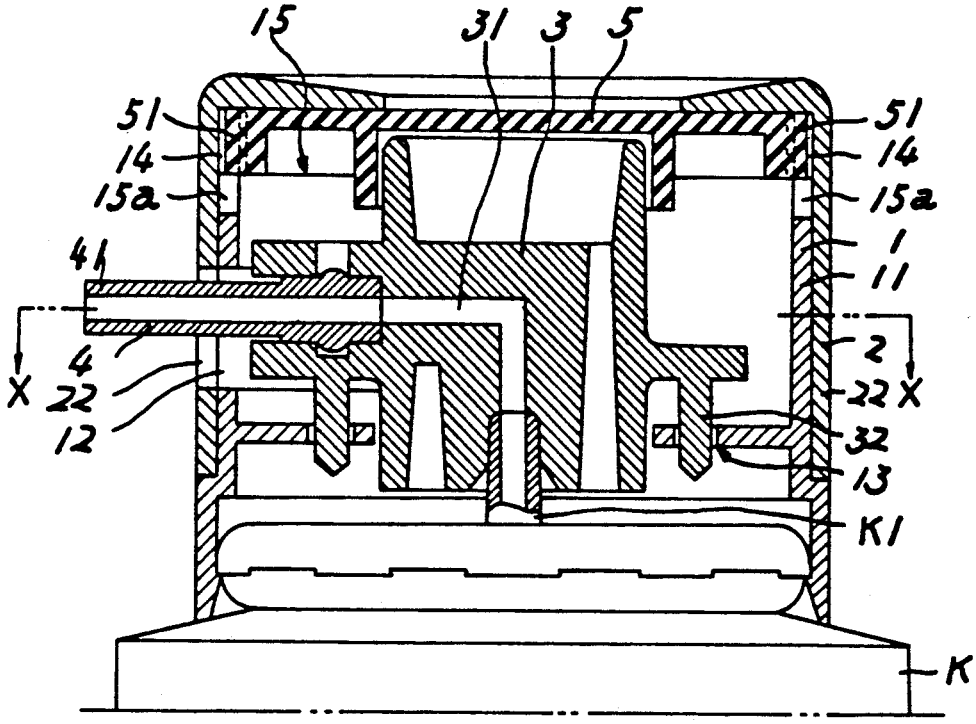
FIG. 1 is a vertical cross-sectional view of the first embodiment of the invention in its operative position.
Figure 2:
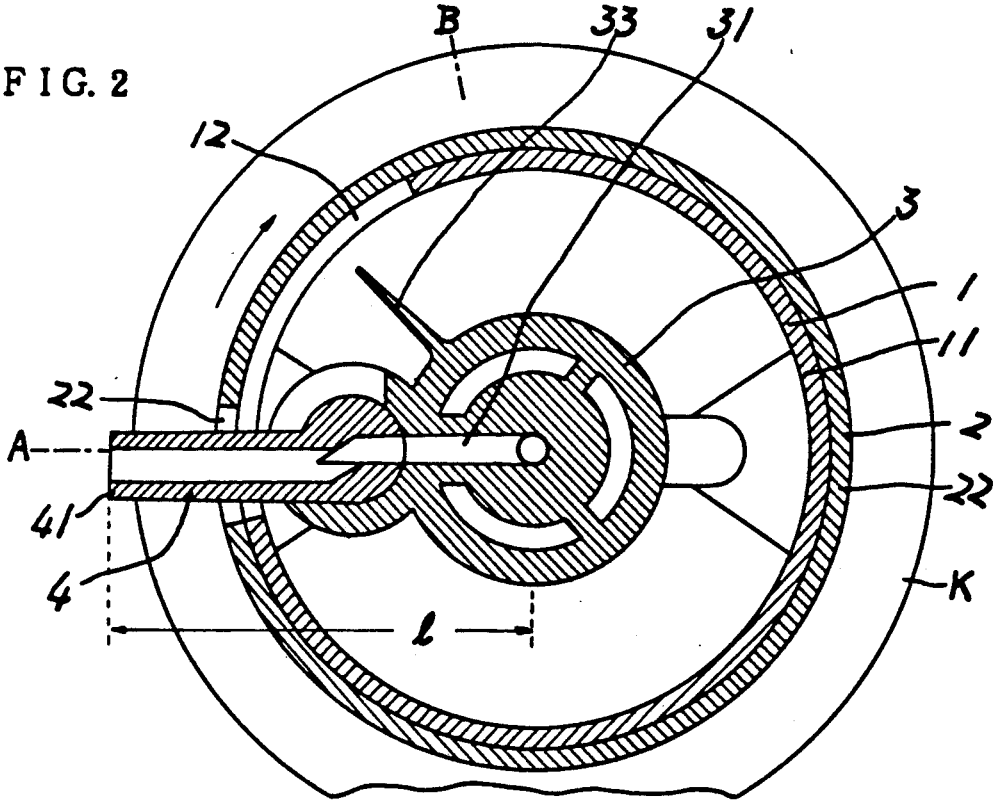
FIG. 2 is a lateral cross sectional view taken at line X—X in FIG. 1.
Figure 3:
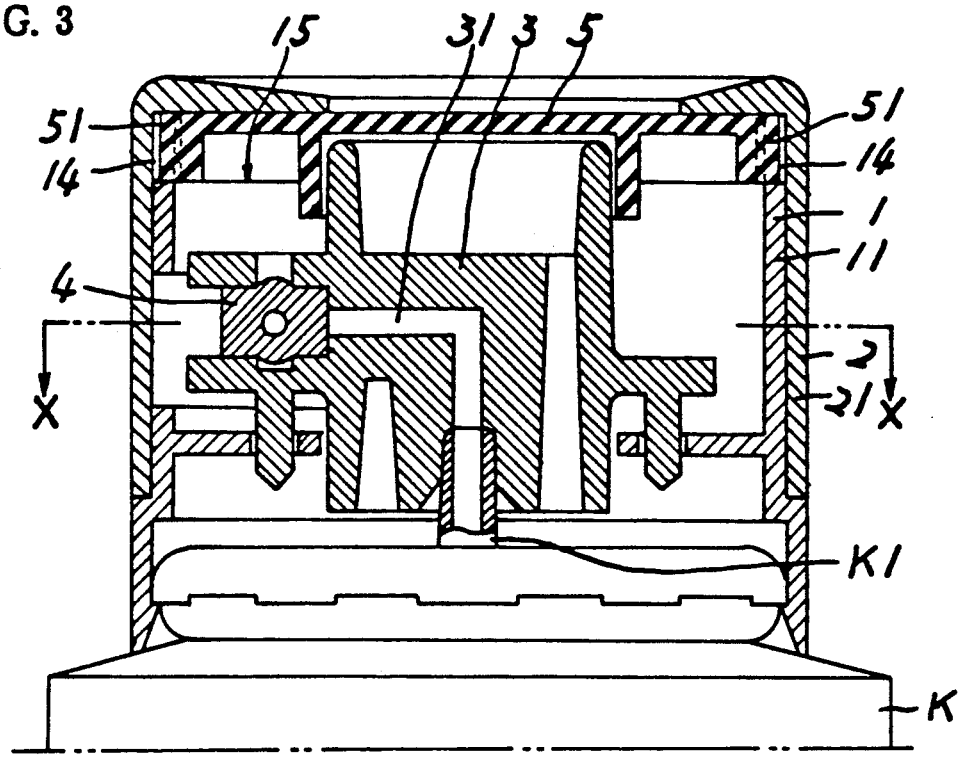
FIG. 3 is a vertical cross-sectional view of the same embodiment in its non-operative position.
Figure 4:
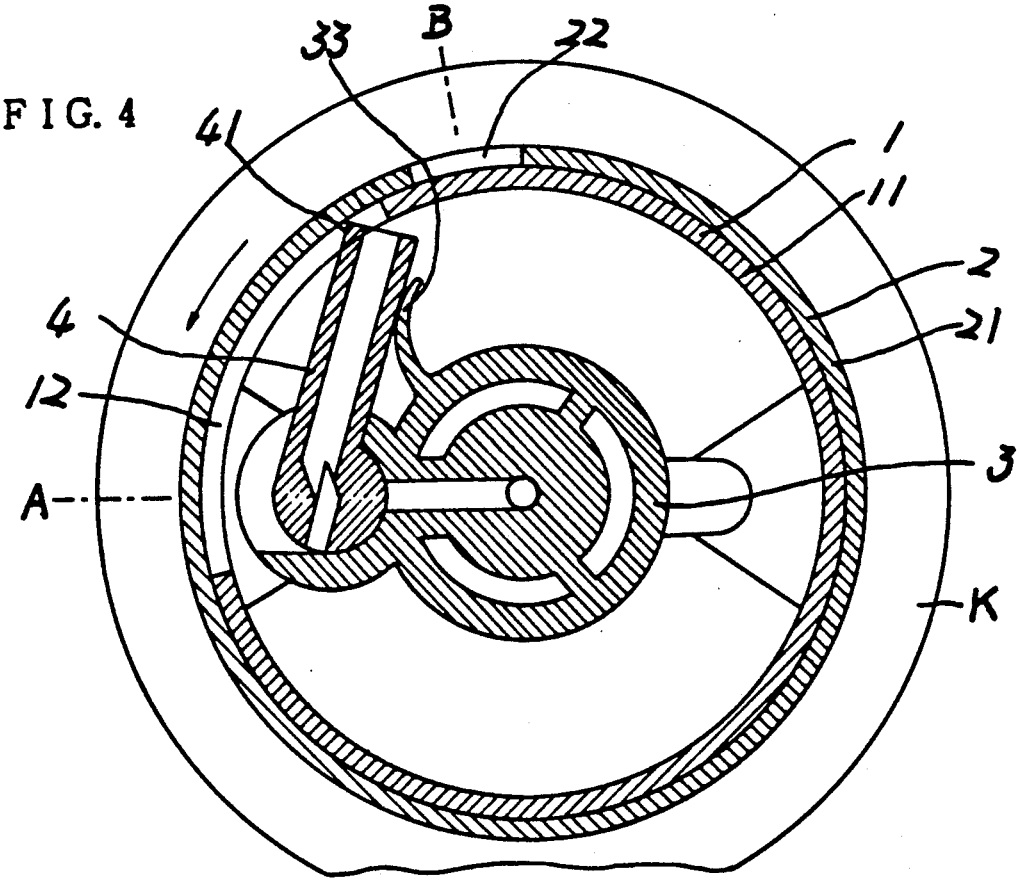
FIG. 4 is a lateral cross-sectional view taken at line X—X in FIG. 3.
Figure 5:
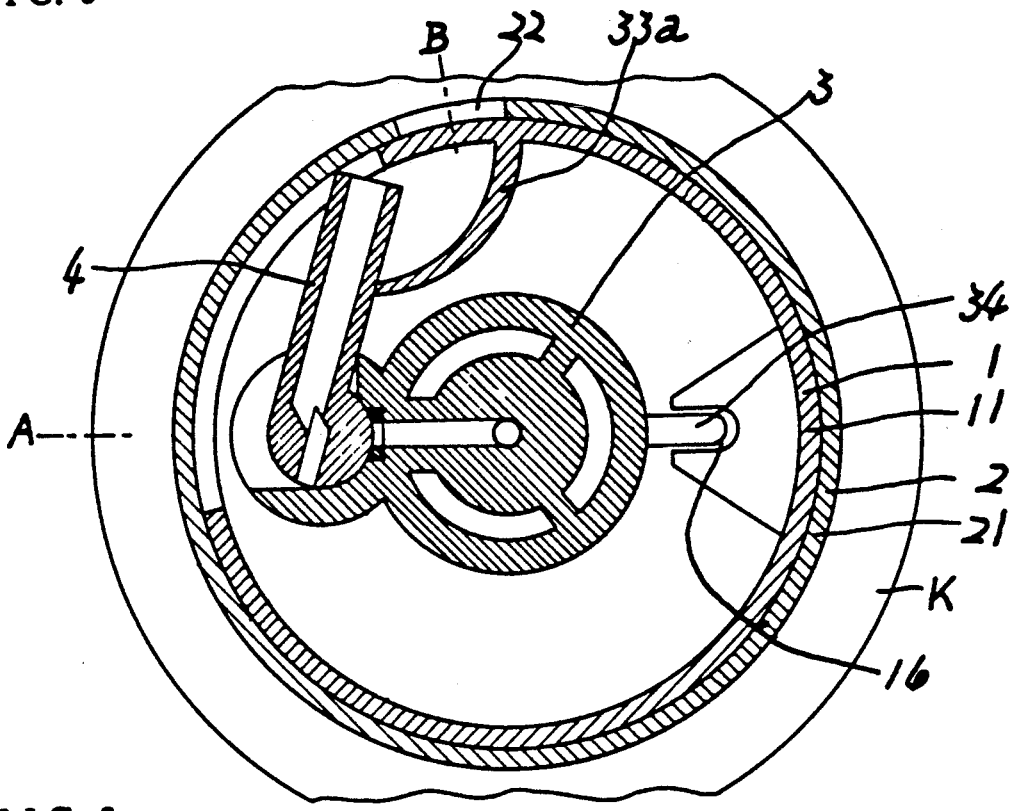
FIG. 5 is a lateral cross-sectional view of a second embodiment of the invention corresponding to FIG. 4 of the first embodiment.

FIG. 5 is a figure as to the second embodiment of this invention which corresponds to FIG. 4 in the first embodiment. In the second embodiment, 33*a* is a spring leaf which corresponds to spring leaf 33 of the first embodiment for effecting a resilient restorative force to nozzle tube 4, and which is molded in one body with non-rotary member 1 out of a resilient plastic material. In this embodiment, push button 3 is non-rotatably supported by dispensing container K by means of short bar 34 projecting outwardly from push button 3 and a groove 16 of a bracket which projects inwardly from cylindrical wall 11 of a non-rotary member 1. Other structures are the same as those in the first embodiment.

Figure 6:
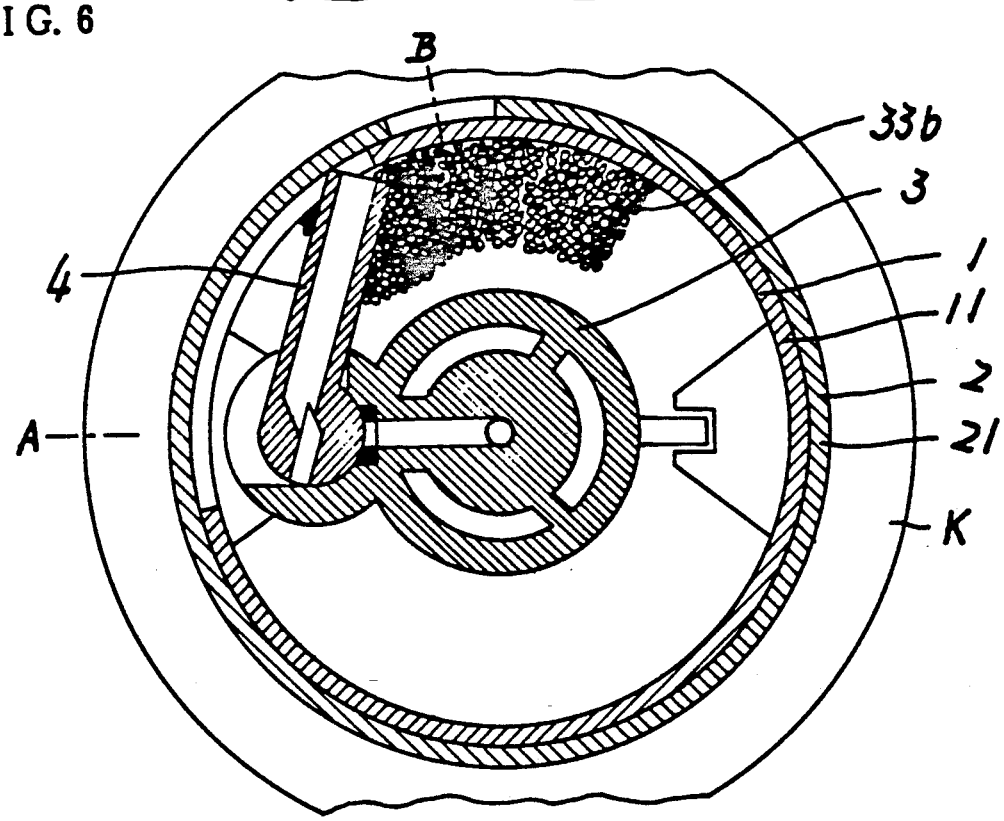
FIG. 6 is a lateral cross-sectional view of a third embodiment corresponding to FIG. 4 of the first embodiment.

FIG. 6 is a lateral cross-sectional view of the third embodiment which corresponds to FIG. 4 in the first embodiment or FIG. 5 in the second embodiment. In this embodiment, other portions, except for the resilient sponge 33*b* bound to the inner face of cylindrical wall 11 of the non-rotary member is provided in place of spring leaf 33*a* in the second embodiment, are the same as those in the second embodiment.

Figure 7:
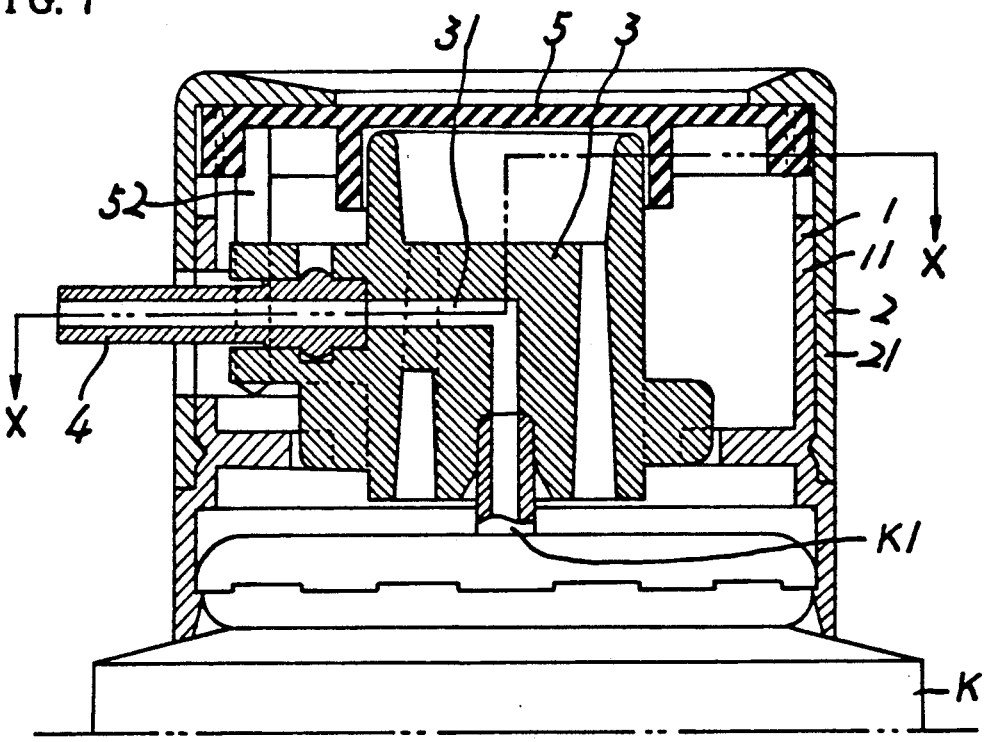
FIG. 7 is a vertical cross-sectional view of a fourth embodiment in its operative position.
Figure 8:
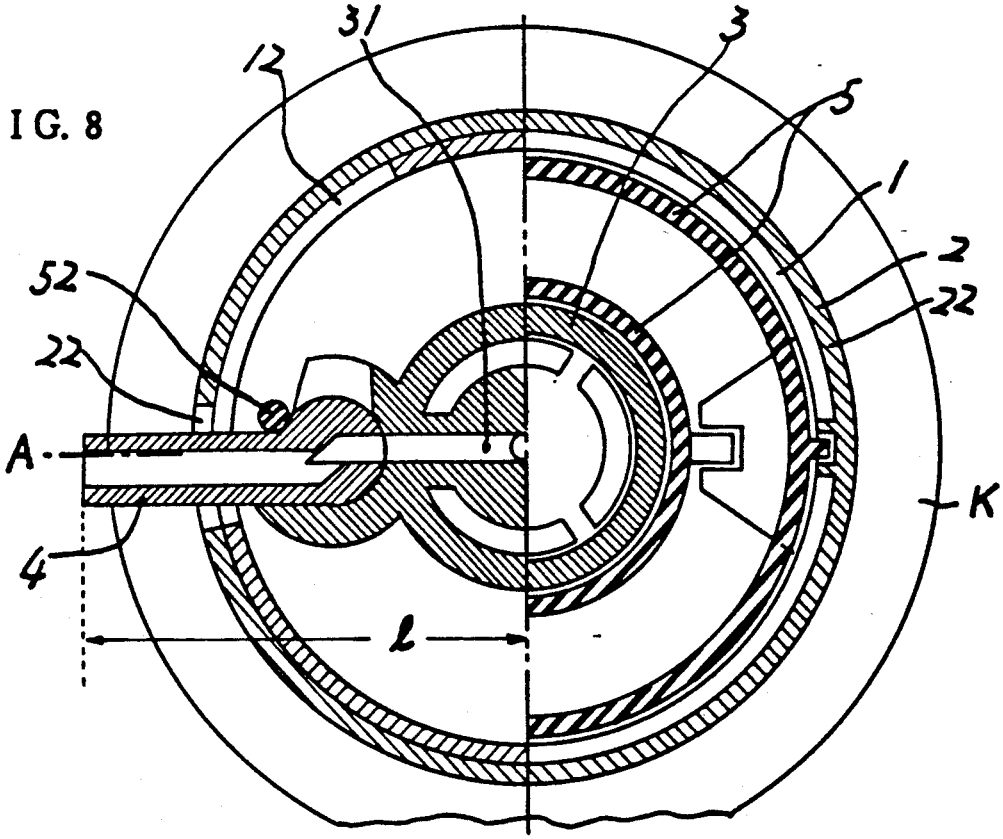
FIG. 8 is a lateral cross-sectional view taken at line X—X in FIG. 7.
Figure 9:
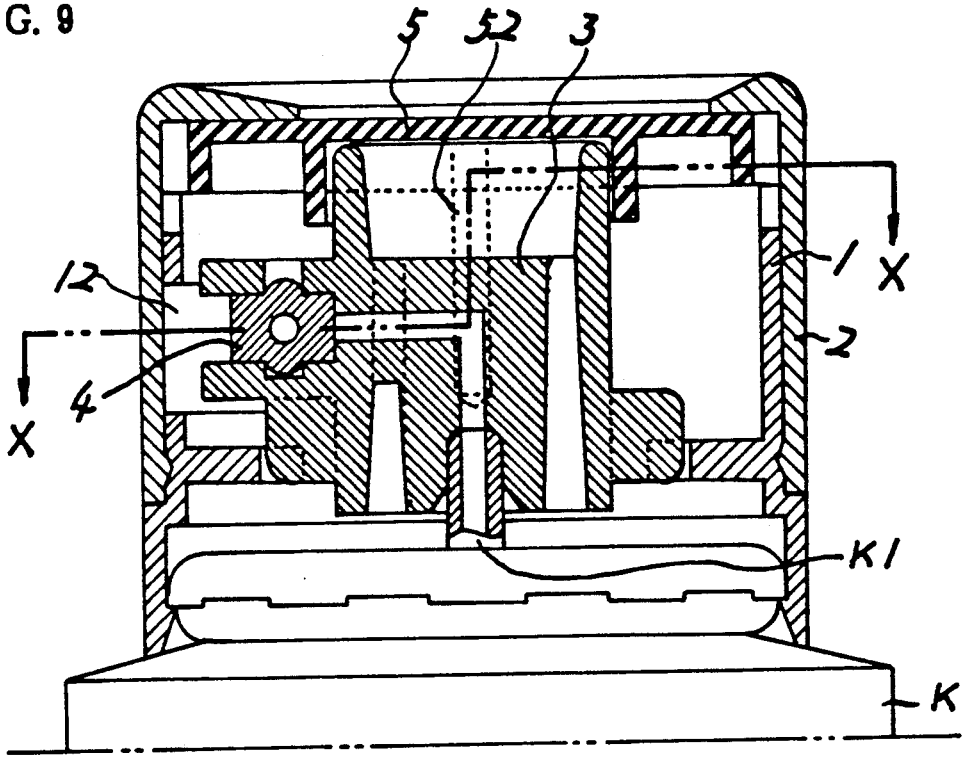
FIG. 9 is a vertical cross-sectional view of the same embodiment in its non-operative position.
Figure 10:
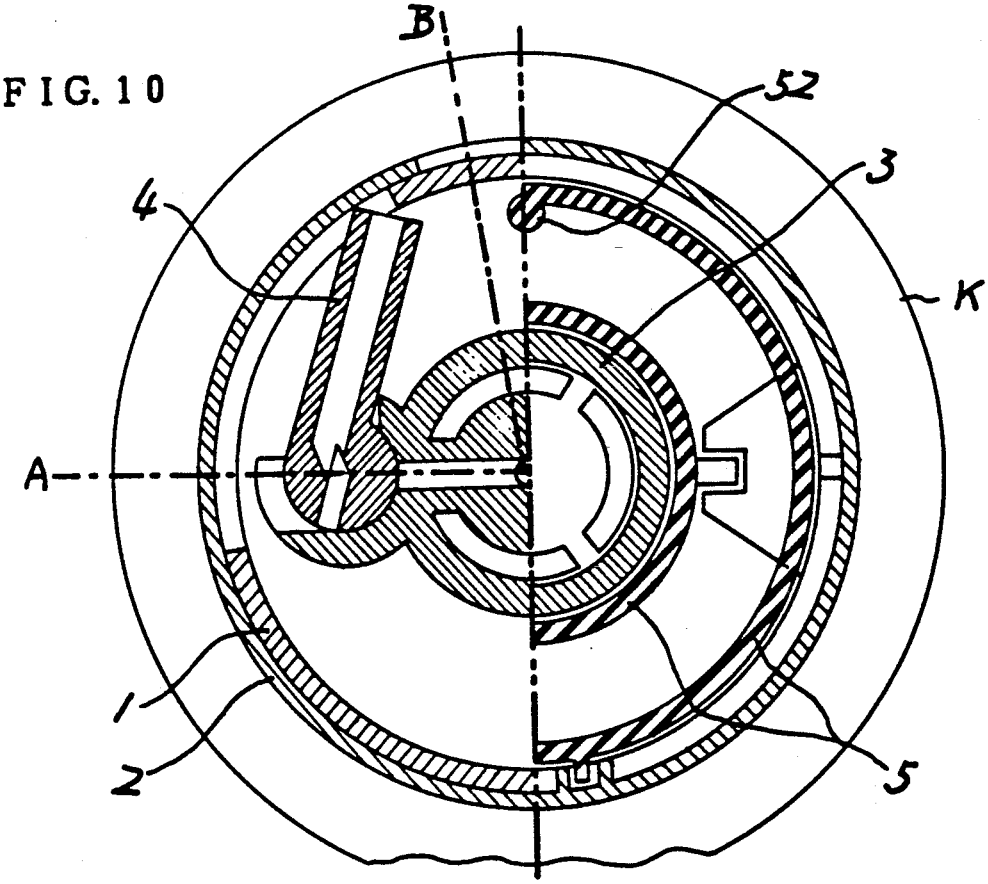
FIG. 10 is a lateral cross-sectional view taken at line X—X in FIG. 9.

Subsequently referring to FIGS. 7 to 10, in the fourth embodiment, push rod 52 hangs from the bottom face of push lid 5 which is supported, non-rotatably to rotary member 2, in the same way as in the first embodiment and, upon recovering the operative position as shown in FIGS. 7 and 8 from the non-operative position as shown in FIGS. 9 and 10, nozzle tube 4 is pushed by push rod 52 so that it may recover its straight state. As to non-rotatable supporting means for push button 3, this embodiment is similar to the foregoing second or third embodiments and as to other parts, they are similar to those of the first embodiment.

Figure 11:
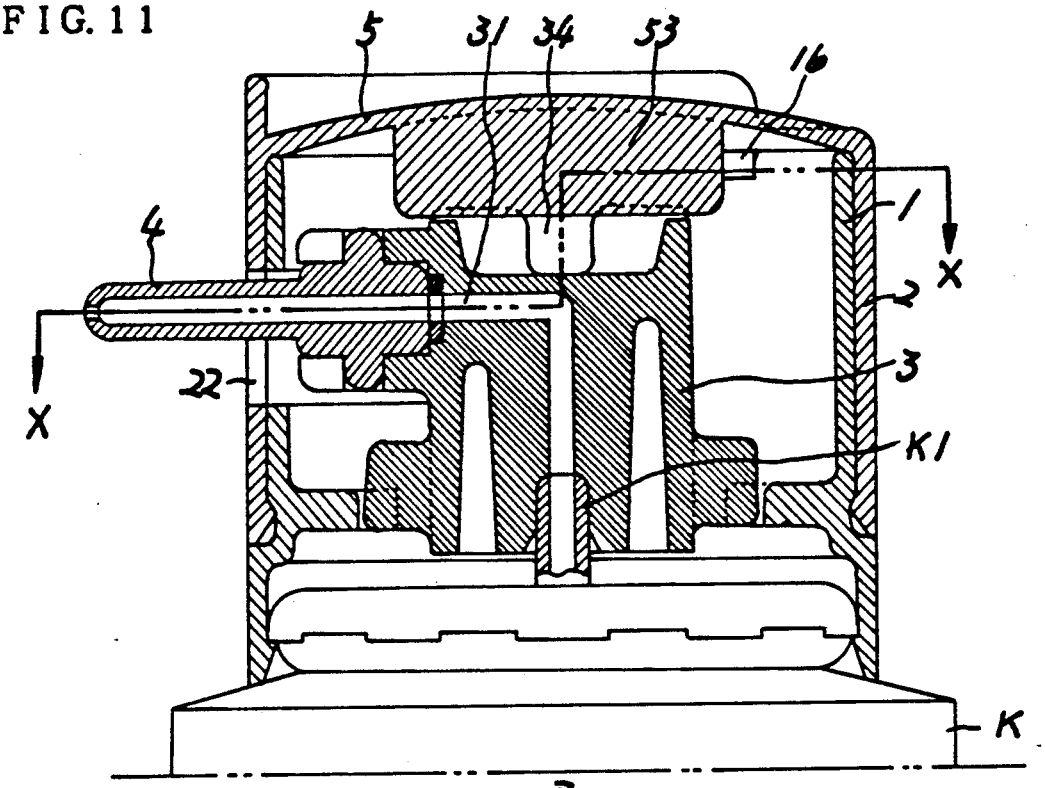
FIG. 11 is a vertical cross-sectional view of a fifth embodiment in its operative position.
Figure 12:
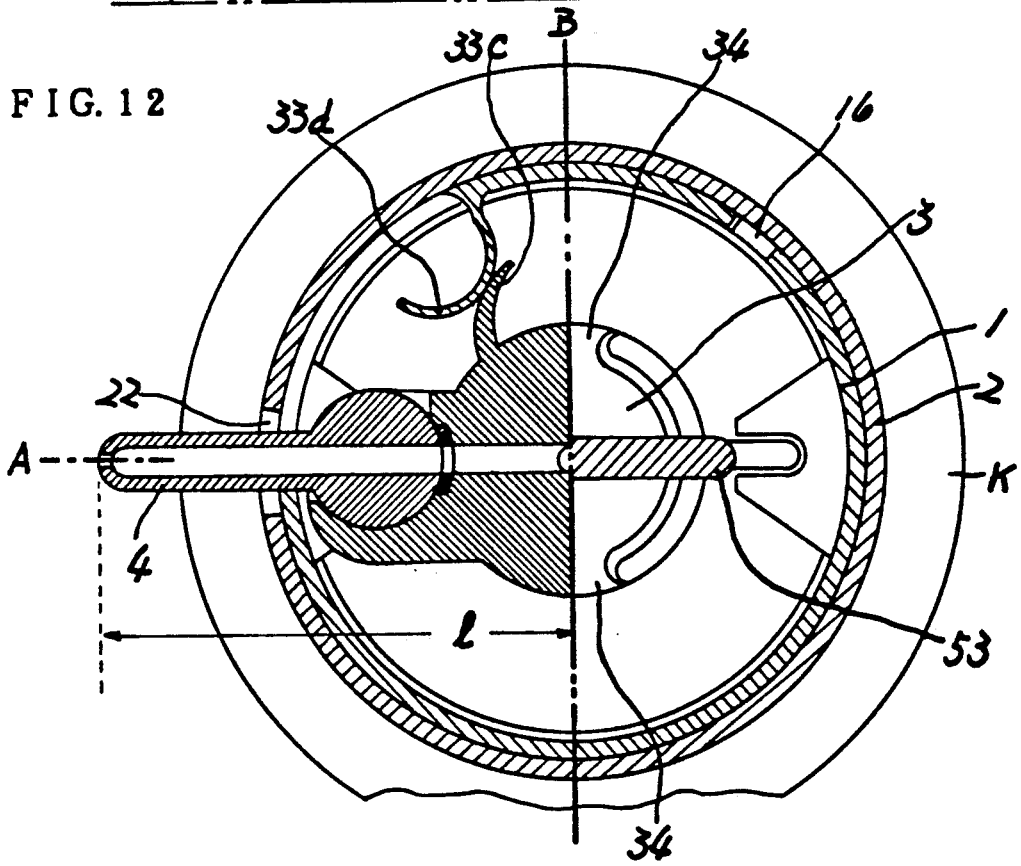
FIG. 12 is a lateral cross-sectional view taken at line X—X in FIG. 11.
Figure 13:
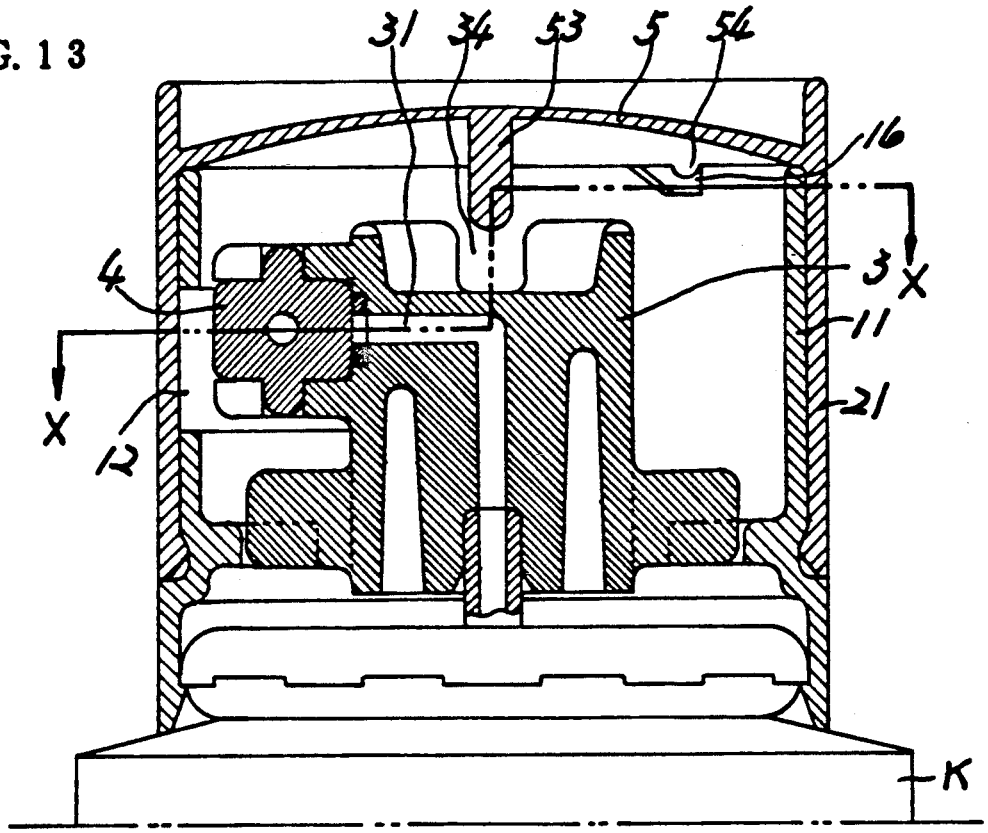
FIG. 13 is a vertical cross-sectional view of the same embodiment in its non-operative position.
Figure 14:
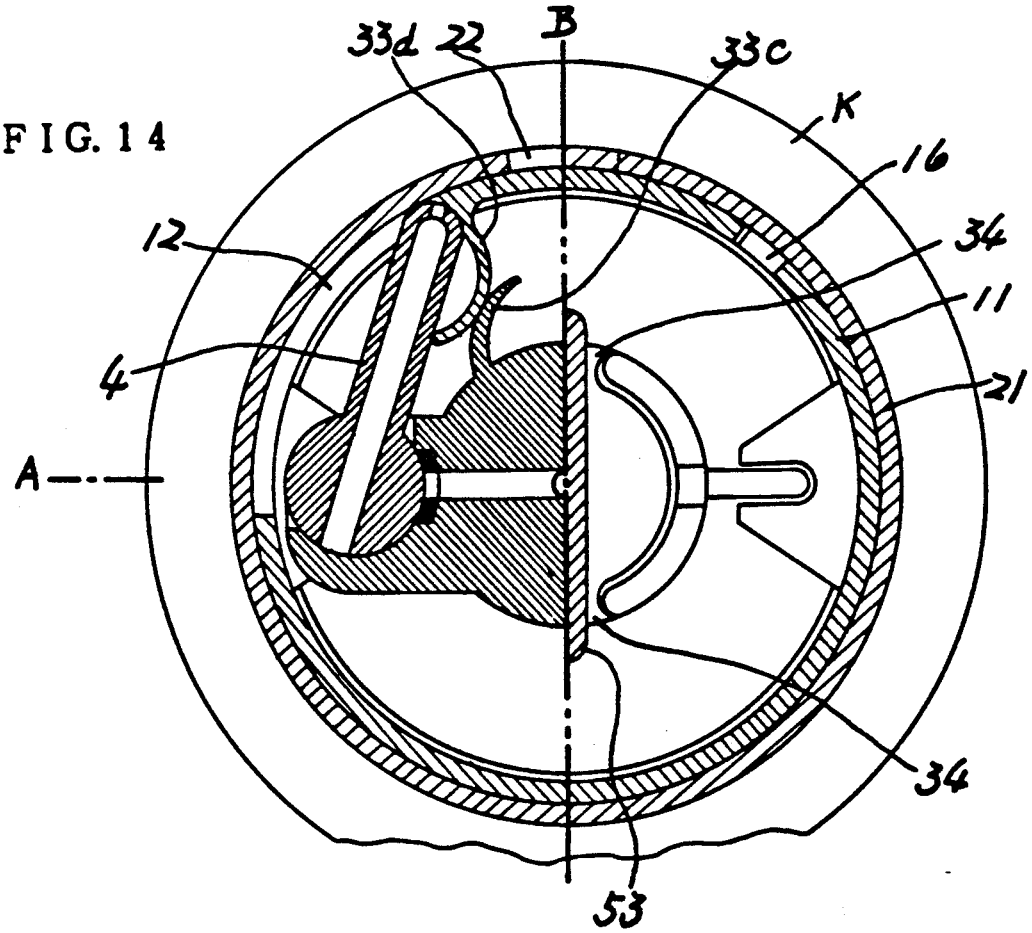
FIG. 14 is a lateral cross-sectional view taken at line X—X in FIG. 13.

Referring to FIGS. 11 to 14 in the fifth embodiment, non-rotatably supporting means for push button 3 are similar to those in the second to fourth embodiments. As to straight state recovering means for nozzle tube 4, spring leaf 33*c*, which is similar to spring leaf 33 (FIG. 2), and spring leaf 33*d*, which is similar to spring leaf 33*b* (FIG. 5), are provided, and by means of these two spring leaves, recovering force at the initial stage of recovering from the non-operative position is intensified. Push lid 5 of this embodiment is molded out of a resilient plastic material in one body with rotary member 2 and has a convex shape, and push plate 53 is provided at the bottom face. A deep groove 34 is formed at the top face of push button 3. In this embodiment, the foregoing interlocking impeding means for push button 3 and push lid 5 consists in the push plate 53 and deep groove 34. Push plate 53 corresponds to a key member in this invention, and deep groove 34 corresponds to a keyhole portion in this invention. That is, engagement of the bottom edge of push plate 53 and the top face of push button 3 is possible at the operative position as shown in FIGS. 11 and 12, interlocking of push lid 5 and push button 3 being impeded at the non-operative position, as shown in FIGS. 13 and 14, because deep groove 34 is located directly under push plate 53, and push plate 53 cannot reach the bottom of deep groove 34 except by means of a simple pushing of push lid 5. Further, in this embodiment, 16 is a small notch provided at the top edge of cylindrical wall 11 of the non-rotary member which, at the non-operative position, as shown in FIGS. 13 and 14, is to cooperate with small projection 54 provided at the bottom face of push lid 5 so as to stabilize the non-operative position.

Figure 15:
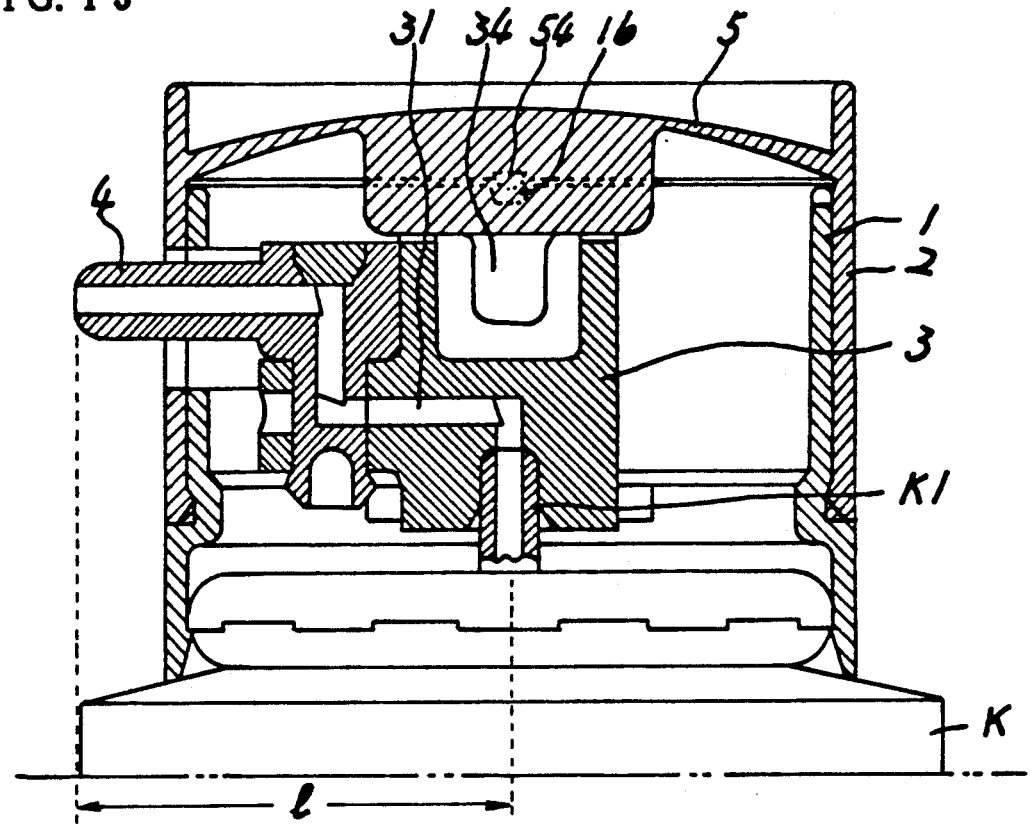
FIG. 15 is a vertical cross-sectional view of a sixth embodiment in its operative position.
Figure 18:
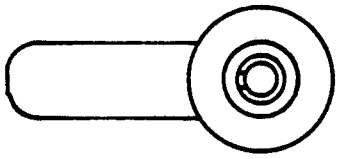
FIG. 18 is a plan view of the nozzle tube of, the same embodiment.
Figure 21:
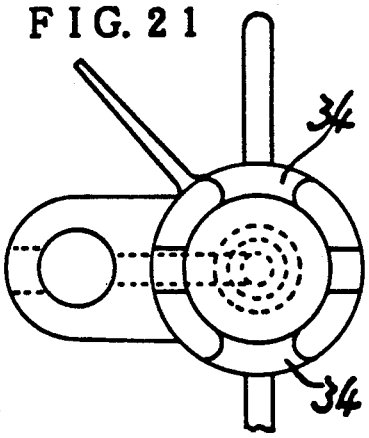
FIG. 21 is a plan view of the push button of the same embodiment.
Figure 19A:
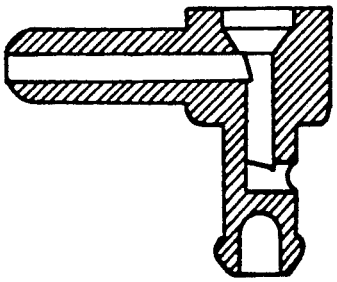
FIG. 19(*a*) is a vertical cross-sectional view of the same.
Figure 19B:
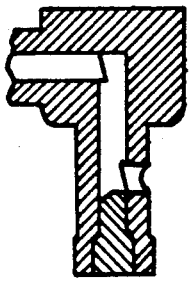
Figure 22:
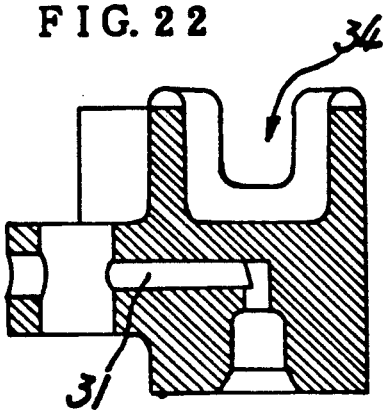
FIG. 22 is a vertical cross-sectional view of the same.
Figure 20:
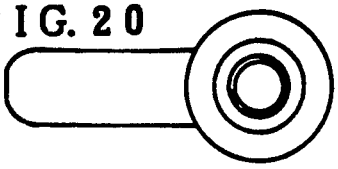
FIG. 20 is a bottom view of the nozzle tube in FIG. 8.
Figure 16:
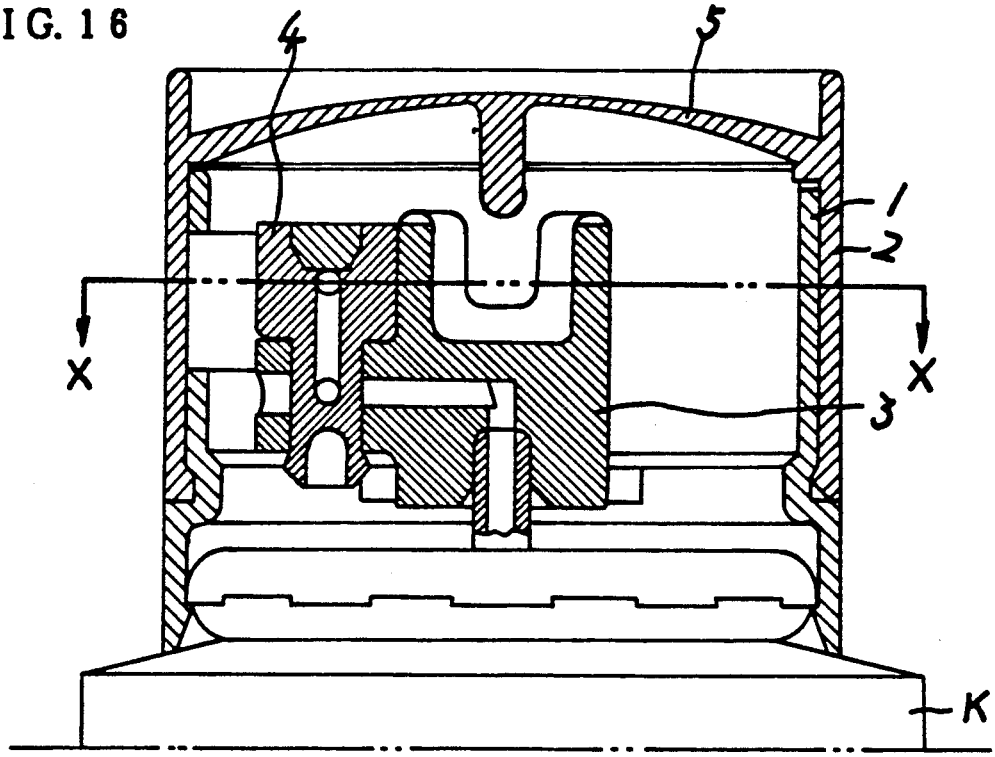
FIG. 16 is a vertical cross-sectional view of the same embodiment in its non-operative position.
Figure 17:
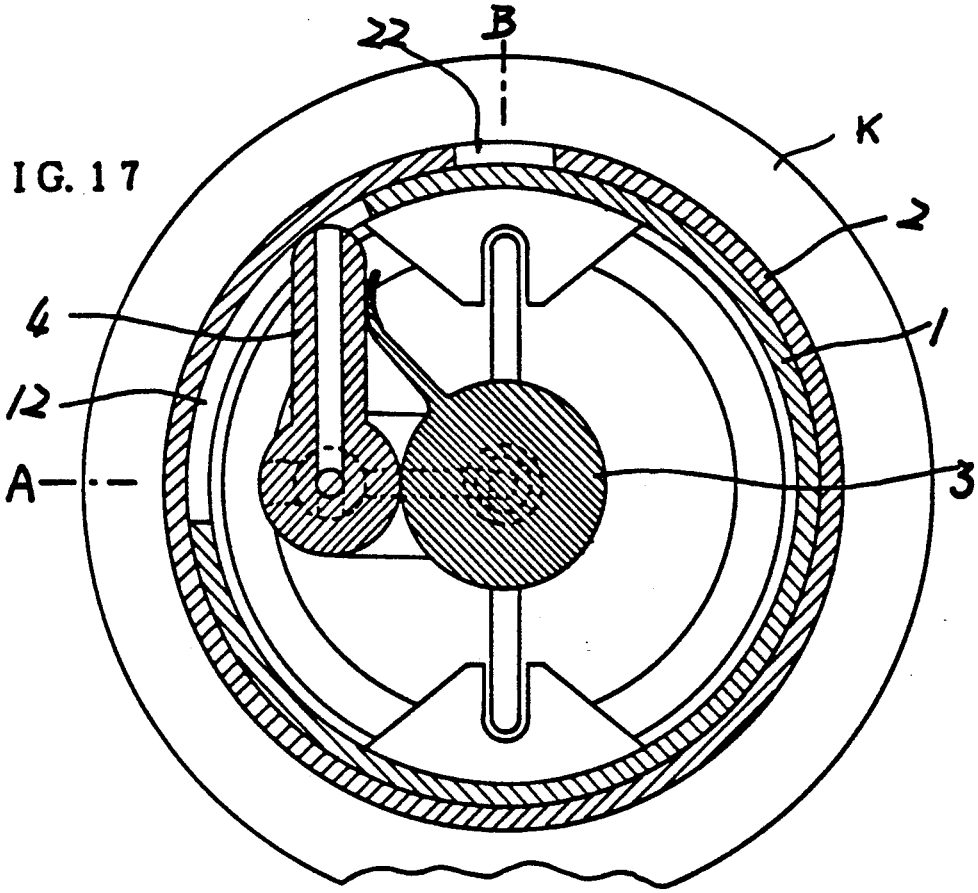
FIG. 17 is a lateral cross-sectional view taken at line X—X in FIG. 16.
Figure 23:
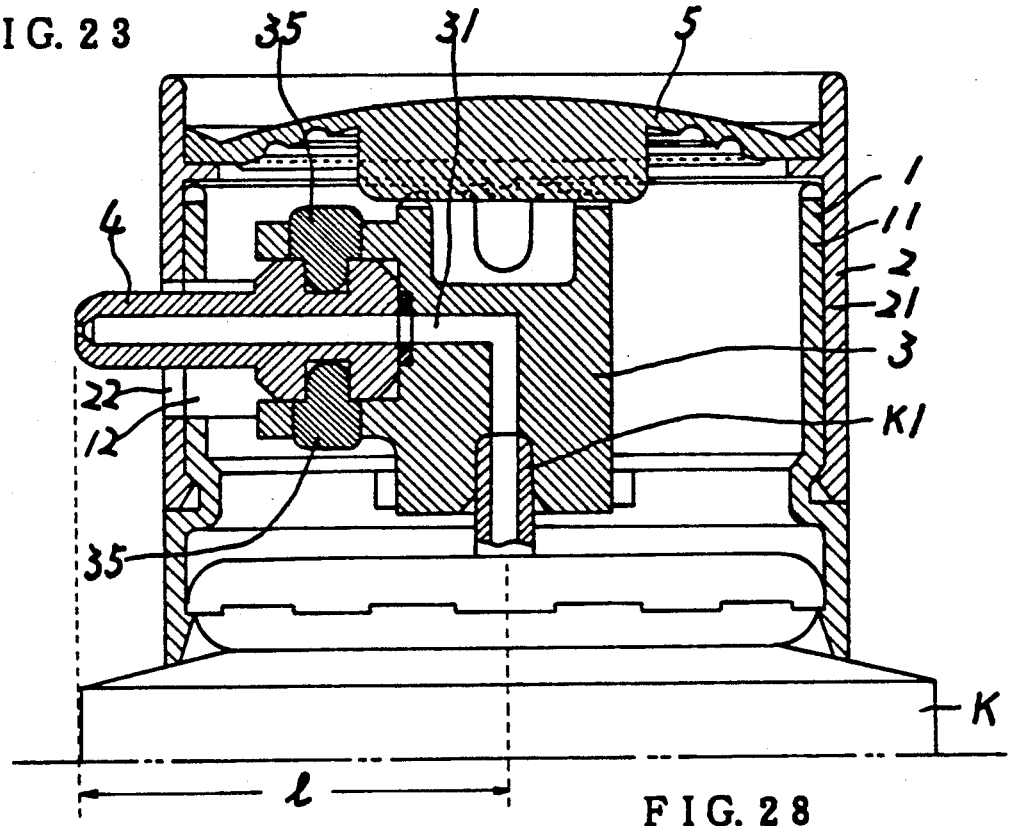
FIG. 23 is a vertical cross-sectional view of a seventh embodiment in its operative position.
Figure 28:
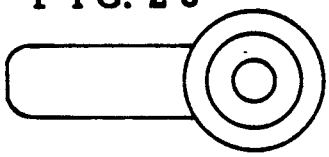
FIG. 28 is a plan view of the same embodiment.
Figure 26:
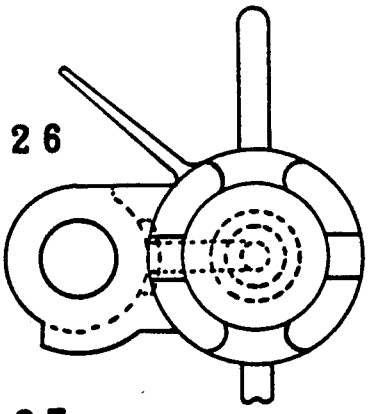
FIG. 26 is a plan view of the push button of the same embodiment.
Figure 29:
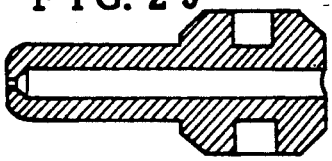
FIG. 29 is a vertical cross-sectional view of the same.
Figure 27:
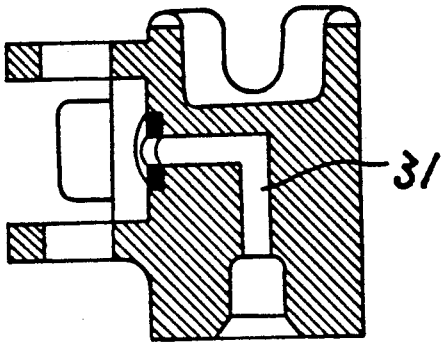
FIG. 27 is a vertical cross-sectional view of the same.
Figure 30:
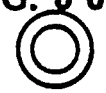
FIG. 30 is a plan view of a pin in the same embodiment.
Figure 31:
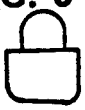
FIG. 31 is a front view of the same.
Figure 32:
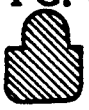
FIG. 32 is a vertical cross-sectional view of the same.
Figure 24:
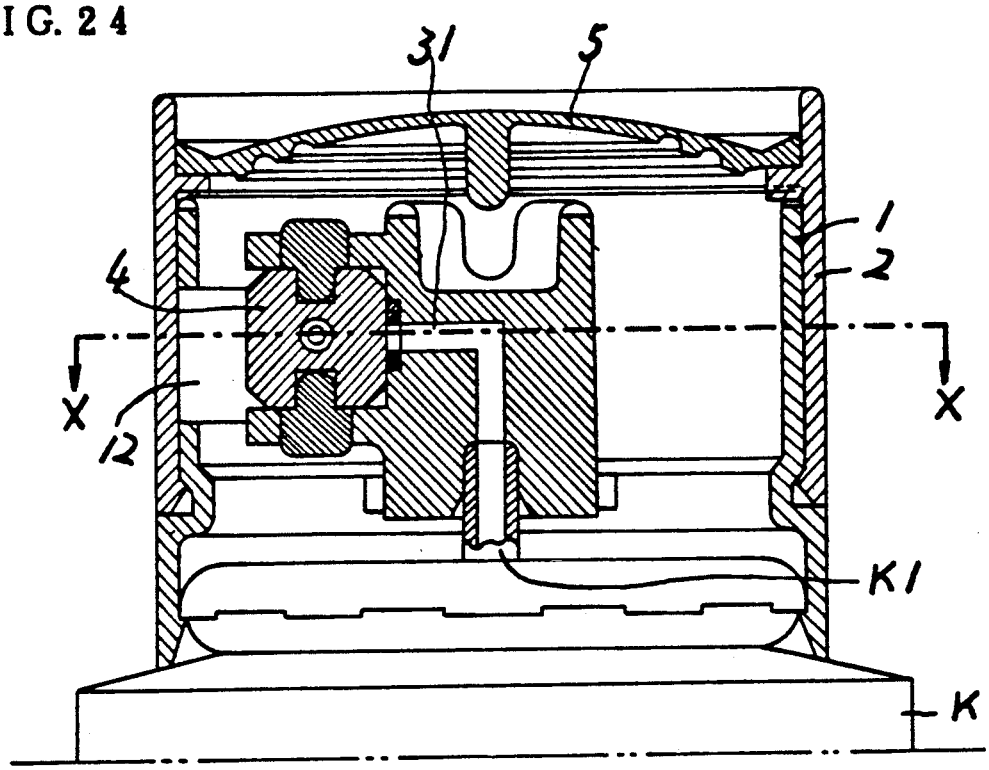
FIG. 24 is a vertical cross-sectional view of the same in its non-operative position.
Figure 25:
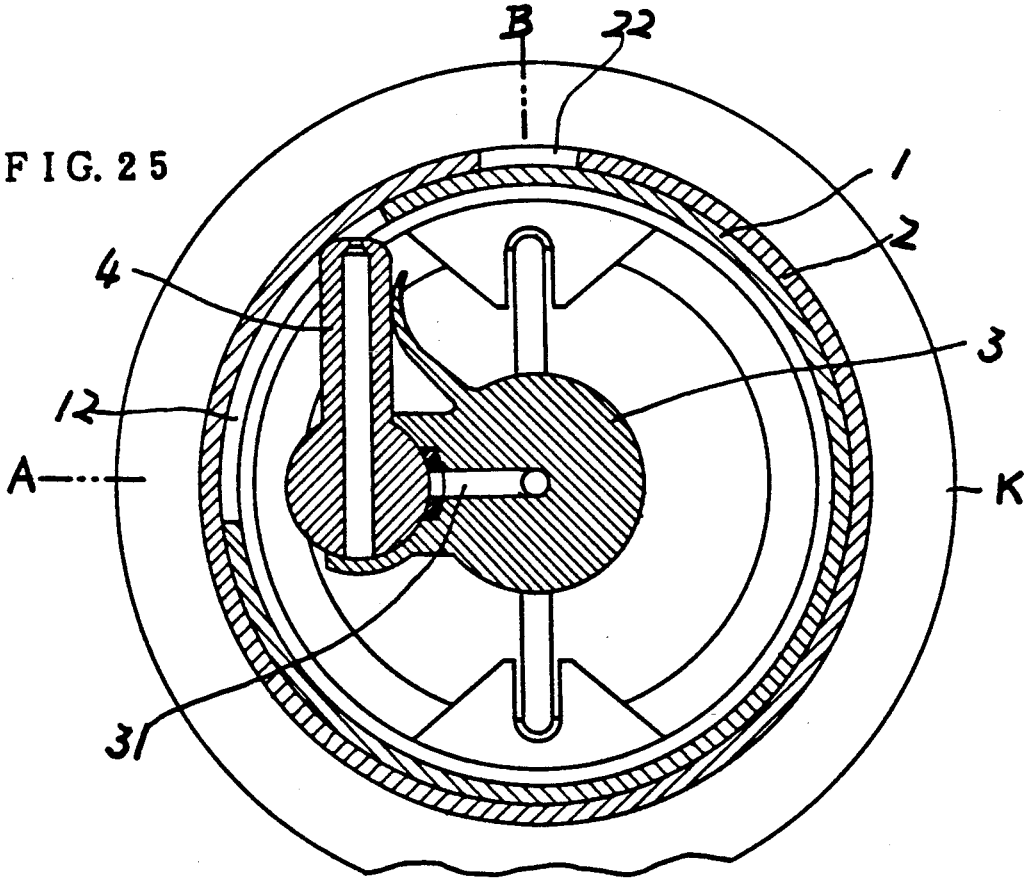
FIG. 25 is a lateral cross-sectional view taken at line X—X in FIG. 24.
Figure 34:
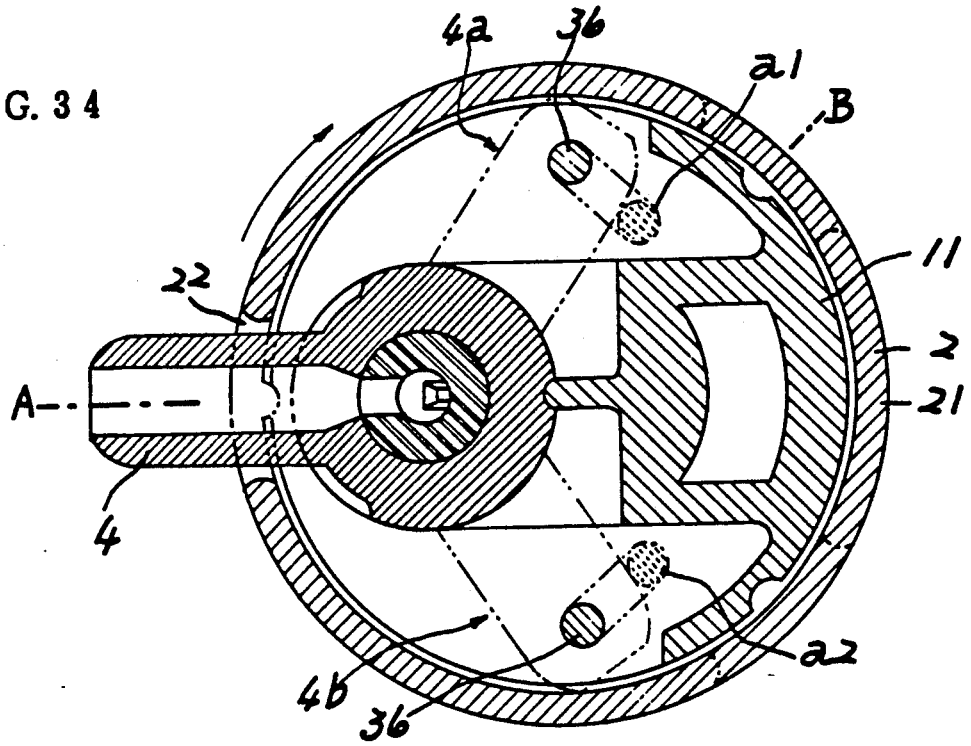
FIG. 34 is a vertical cross-sectional view taken at line X—X in FIG. 33.
Figure 33:
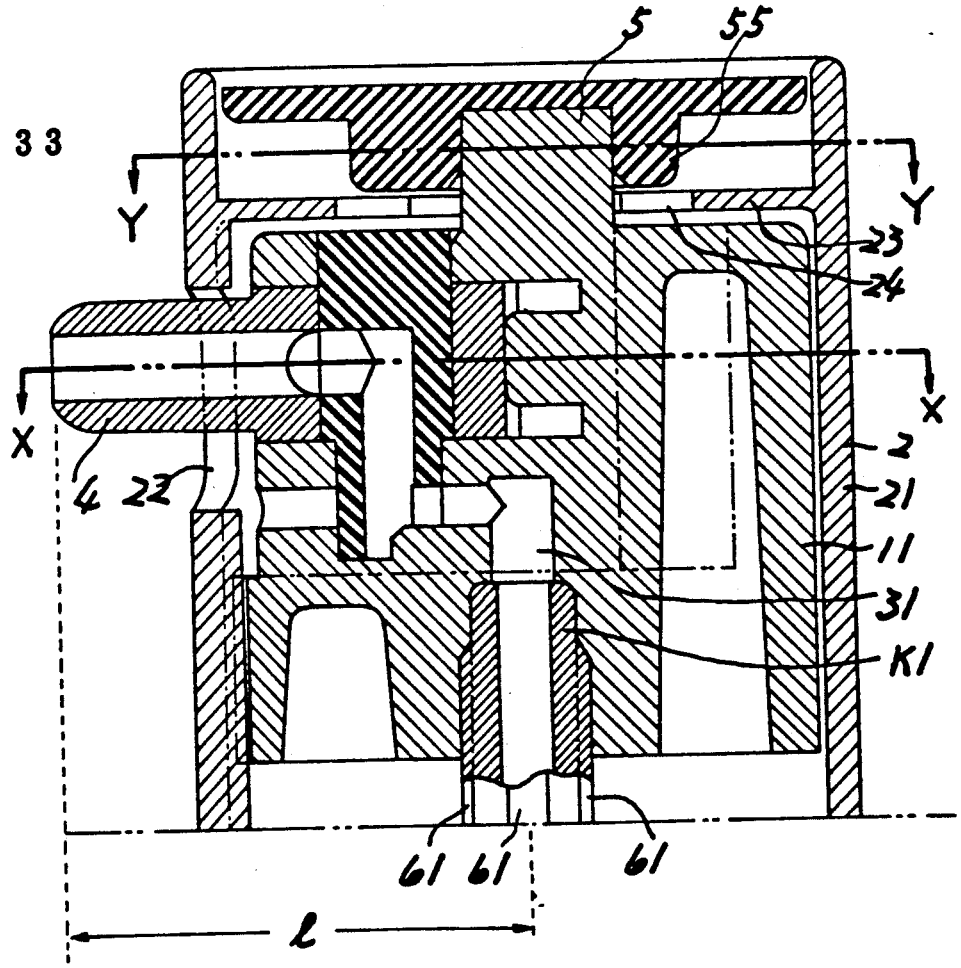
FIG. 33 is a vertical cross-sectional view shown in the main portion of the eighth embodiment in its operative position.
Figure 35:
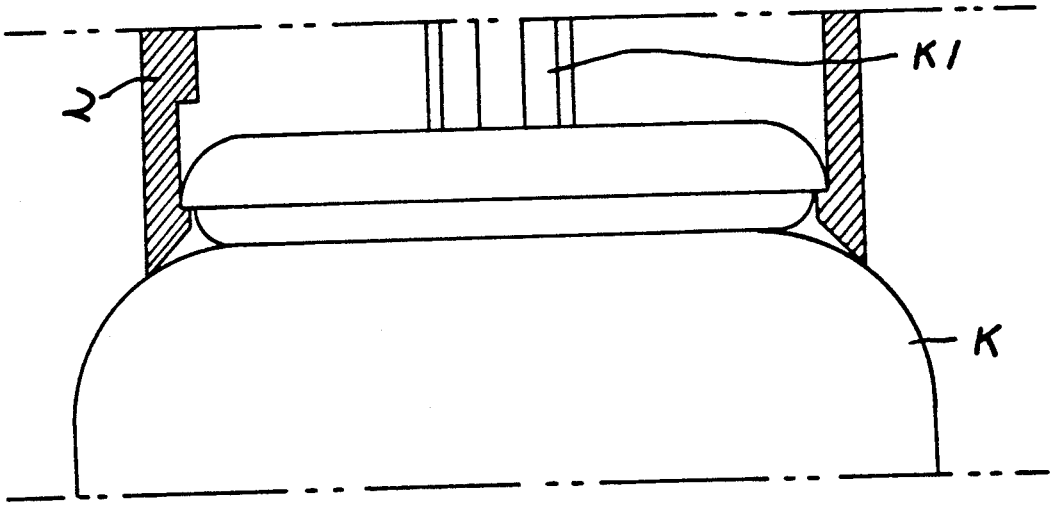
FIG. 35 is a vertical cross-sectional view of the main portion of the portion attached to the dispensing container of the same embodiment.
Figure 36:
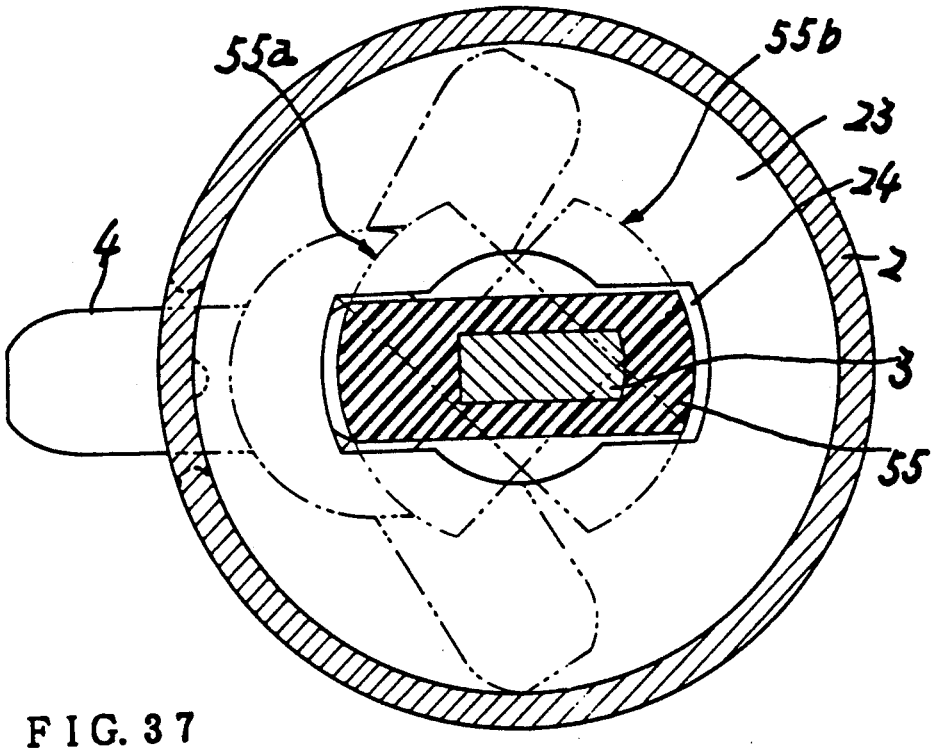
FIG. 36 is a lateral cross-sectional view taken in line Y—Y in FIG. 33.
Figure 37:
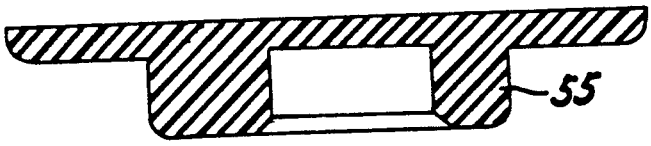
FIG. 37 is a vertical cross-sectional view of the push lid of the same embodiment.
Figure 38:
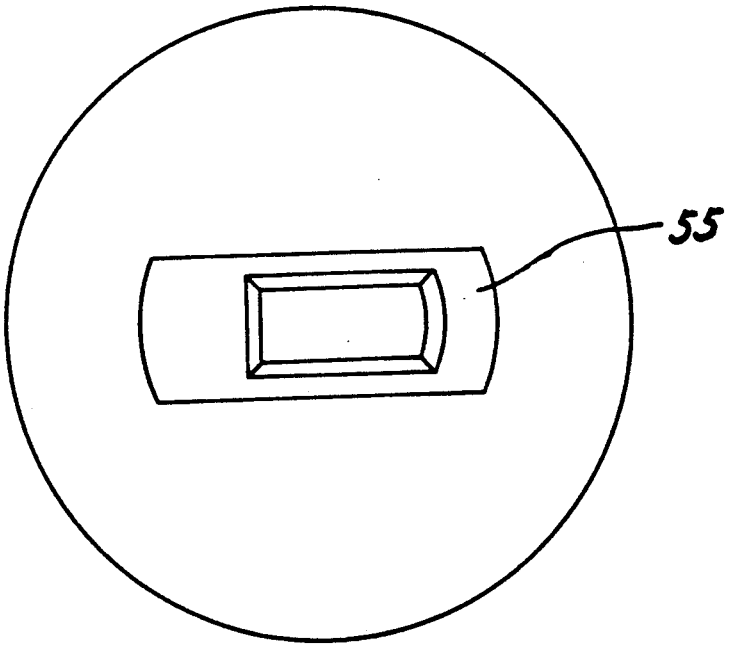
FIG. 38 is a bottom view of the same.
Figure 39:
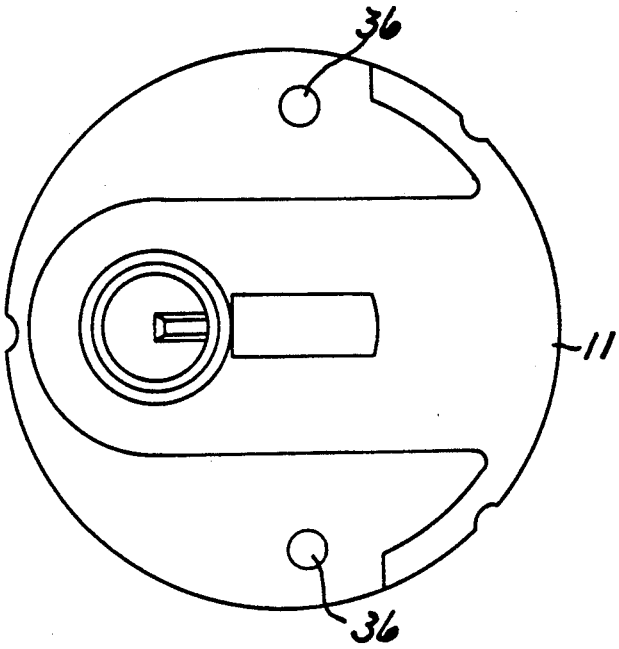
FIG. 39 is a plan view of the push button of the same embodiment.
Figure 41:
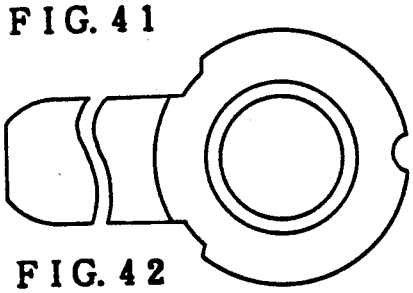
FIG. 41 is a plan view of the nozzle tube of the same embodiment.
Figure 42:
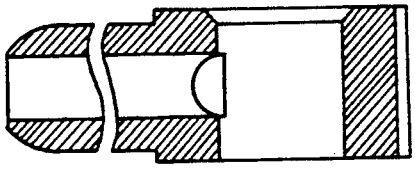
FIG. 42 is a vertical cross-sectional view of the same.
Figure 43:
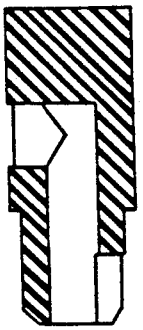
FIG. 43 is a vertical cross-sectional view of the axial pin of the same.
Figure 44:
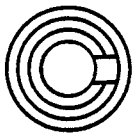
FIG. 44 is a bottom view of the same.

Referring to FIGS. 15 to 22, non-rotatable supporting means of push button 3 and straight mode recovering means in the sixth embodiment, as will be understood particularly from FIGS. 17 and 21, are similar to those in the first embodiment. Push lid 5 is made in one body with rotary member 2 and, as to the interlocking means for push lid 5 and push button 3 at the non-operative position, they are similar to those in the fifth embodiment. This is an embodiment in which the base portion of nozzle tube 4 is designed particularly so that height of the whole dispensing head can be made lower than the fifth embodiment and so that the deep groove can be made deeper. Further, according to this embodiment, small projection 54 and small notch 16, similar to those in the fifth embodiment, are provided so that the operative position which is shown in FIG. 15 can be stabilized.

Subsequently, referring to FIGS. 23 to 32, in the seventh embodiment, nozzle tube 4 is supported pivotally by means of a pair of pins 35 so that mounting work can be simplified. Other structures are substantially similar to those in the fifth and sixth embodiments.

Figure 40:
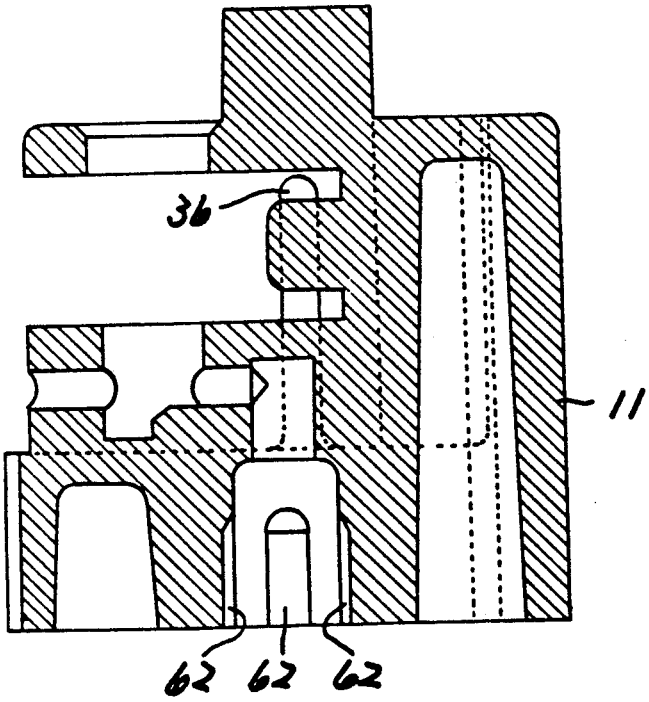
FIG. 40 is a vertical cross-sectional view of the same.

The eighth embodiment is shown in FIGS. 33 to 44. However, cylindrical wall 11 in each embodiment as explained in the foregoing is fixed to dispensing container K at the skirt portion of said wall 11 and cylindrical wall 11 of the non-rotary member in this embodiment is molded in one body with push button 3 so that the same can stand apart from dispensing container K. As will be understood from the Figures, valve stem K1 moves up and down non-rotatively with the dispenser container under the guidance of vertical lamellas 61 projecting outwardly from valve stem K1. Push button 3, as illustrated in FIG. 40, is provided with vertical grooves 62 which correspond to vertical lamellas 61, so that push button 3 can be supported non-rotatively by valve stem K1. In the foregoing embodiments, the notch provided at the front portion of the non-rotary member has a feature like a long lateral bore. However, according to this embodiment, it is formed as a wide space between the right and left ends of cylindrical wall 11 as will be understood particularly from FIG. 34 or FIG. 39. Recovery to straight mode of nozzle tube 4 which has been bent is effected by means of a spring bar 36 appearing particularly clearly in FIGS. 39 and 40. Spring bar 36 is molded in one body with push button 3 out of a resilient plastic material. Further, in FIG. 34, nozzle tube 4, which is in a bent mode at the non-operative position, is indicated at double point chain lines 4*a* and 4*b*. Upon nozzle tube 4 moving from a position which corresponds to the operative position to a position which corresponds to the non-operative position, the end portion of a spring bar is pushed by nozzle tube 4 so as to move to a position indicated at a1 or a2 and will effect nozzle tube 4 side pressure. In this embodiment, as will be understood particularly from FIG. 33 or FIG. 36, because shank portion 55 of push lid 5 has a cross-section of a rectangular form and groove bore 24 which corresponds to shank portion 55 is provided in shelf plate 23 attached to rotary member 2, downward movement of push lid 5 is allowed upon shank portion 55 being inserted in groove bore 24 at the non-operative position. However, at the non-operative position, shank portion 55 cannot be inserted in groove bore 24, and as a result, interlocking of push lid 5 and push button 3 upon downward action of push lid 5 is impeded. Position of shank portion 55 corresponding to the non-operative position are indicated at chain lines 55*a* and 55*b* in FIG. 36. Accordingly, shank portion 55 and groove bore 24 correspond respectively to a key member and a keyhole portion in this invention.

Figure 45:
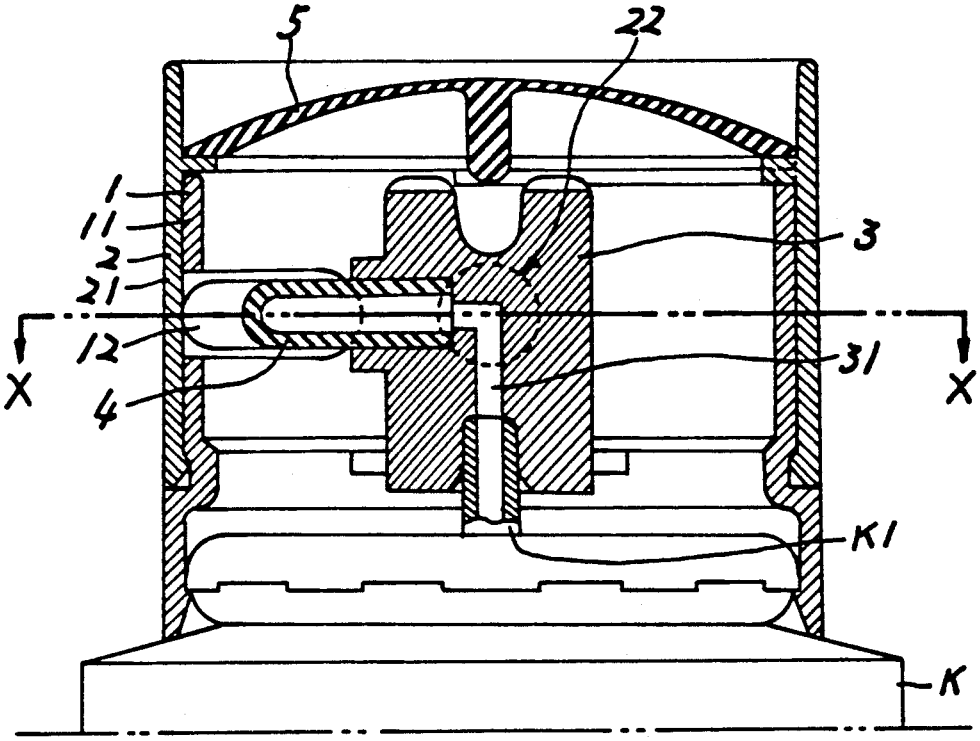
FIG. 45 is a vertical cross-sectional view of the ninth embodiment in its non-operative position.
Figure 46:
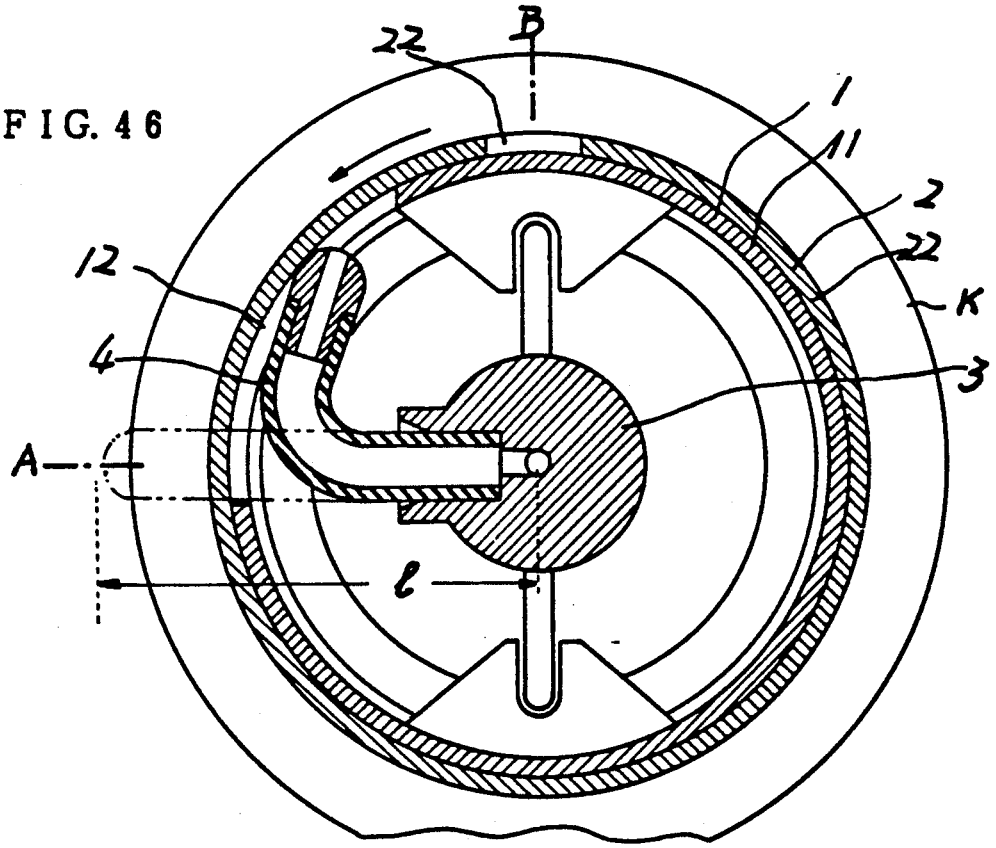
FIG. 46 is a lateral cross-sectional view taken at line X—X in FIG. 45.
Figure 47:
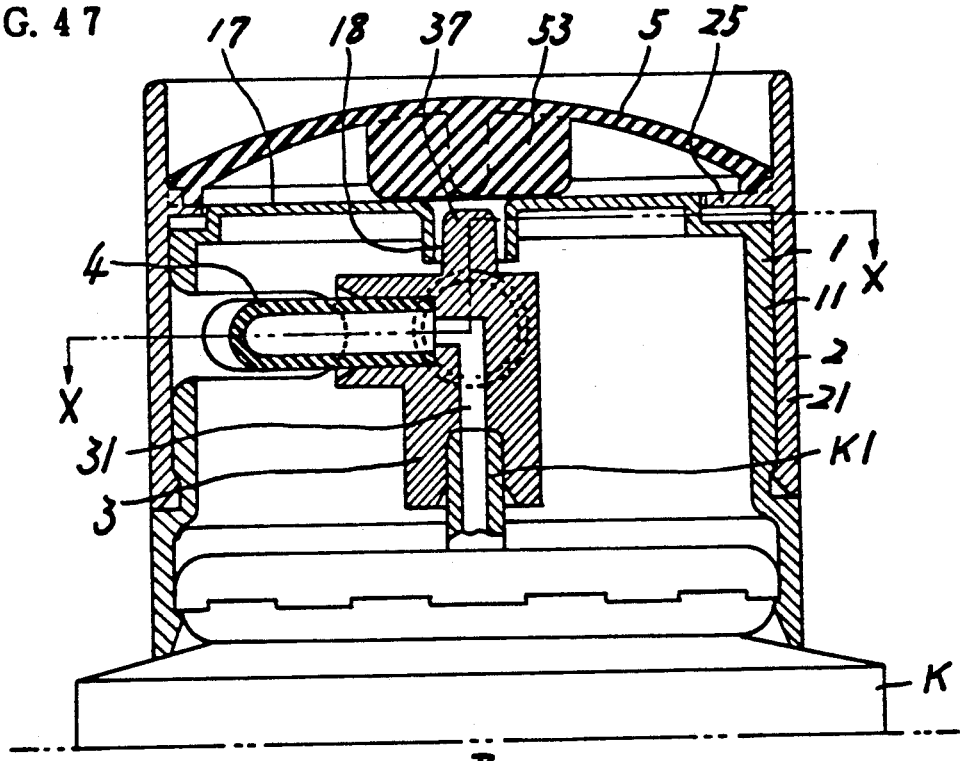
FIG. 47 is a vertical cross-sectional view of a tenth embodiment in its non-operative position.
Figure 48:
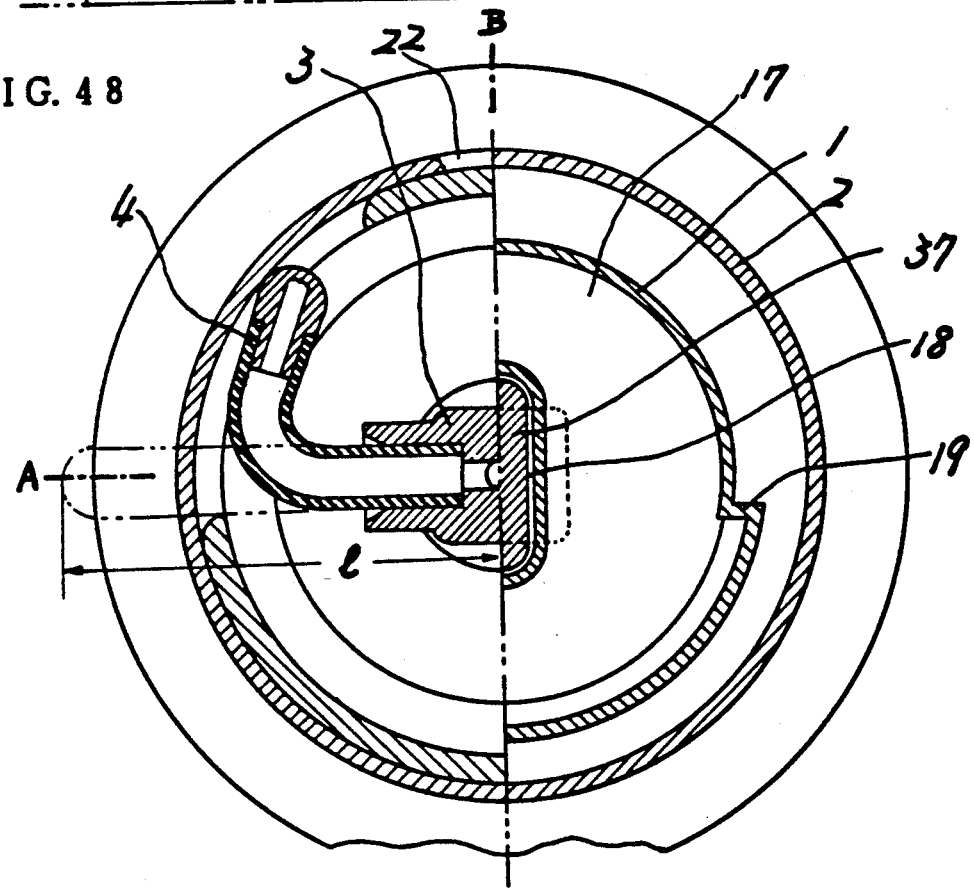
FIG. 48 is a lateral cross-sectional view taken at line X—X in FIG. 47.
Figure 49:
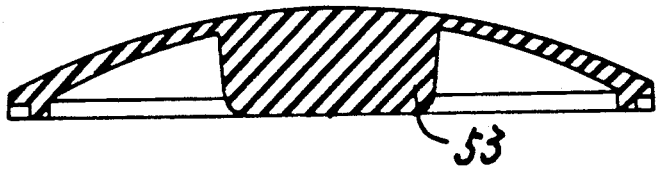
FIG. 49 is a vertical cross-sectional view of the push lid of the same embodiment.
Figure 50:
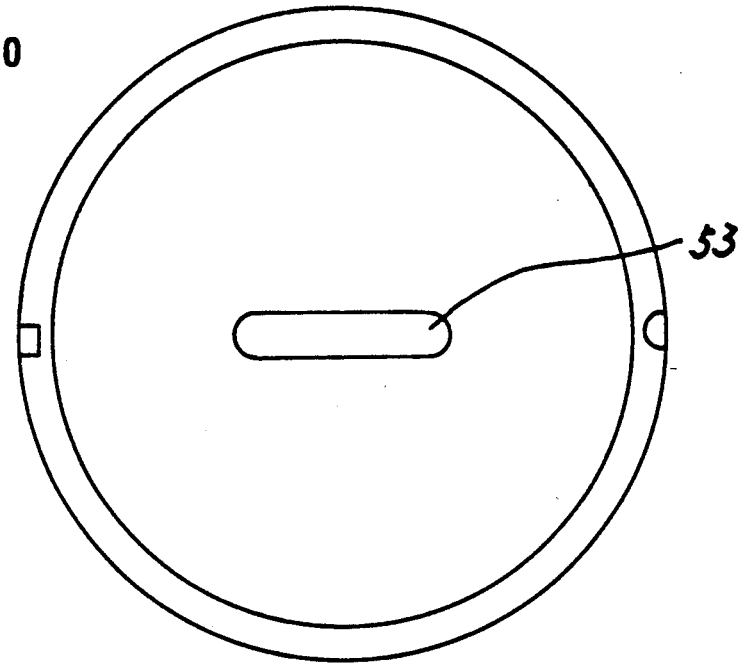
FIG. 50 is a bottom view of the same.
Figure 51:
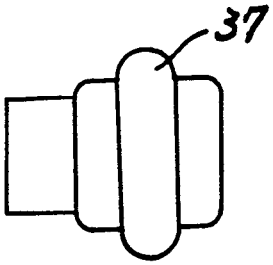
FIG. 51 is a plan view of the push button of the same embodiment.
Figure 52:
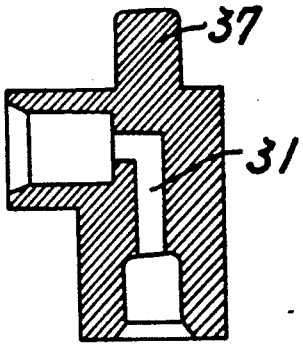
FIG. 52 is a vertical cross-sectional view of the same.
Figure 53:
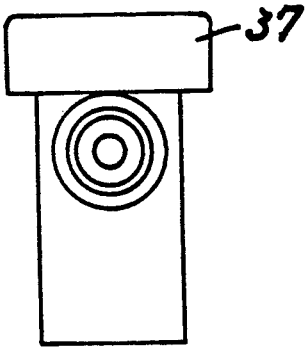
FIG. 53 is a front view of the same.
Figure 55:
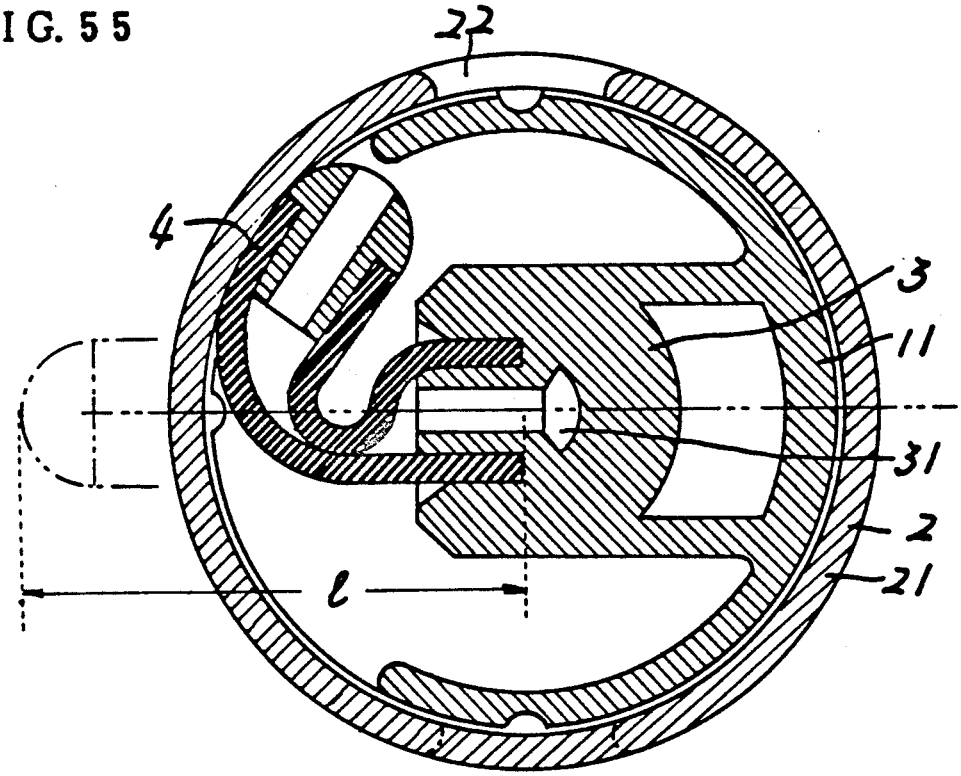
FIG. 55 is a lateral cross-sectional view taken at line X—X in FIG. 54.
Figure 54:
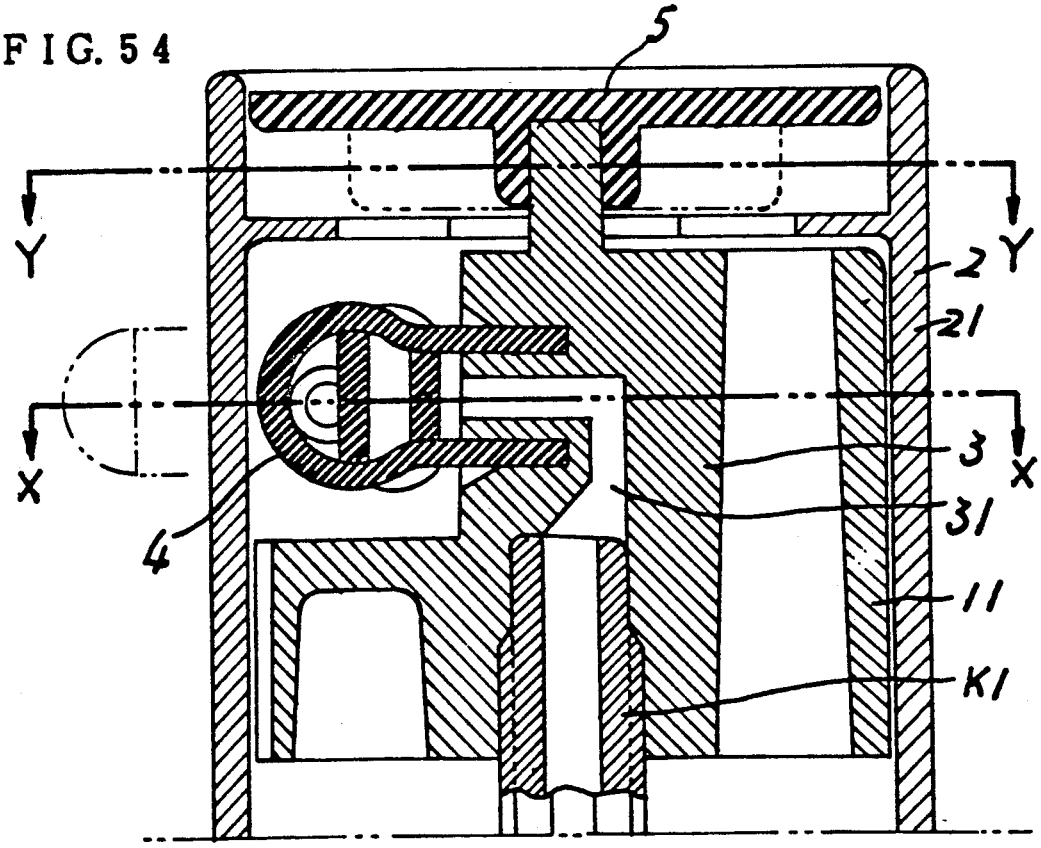
FIG. 54 is a vertical cross-sectional view of the main portion of an eleventh embodiment in its non-operative position.
Figure 56:
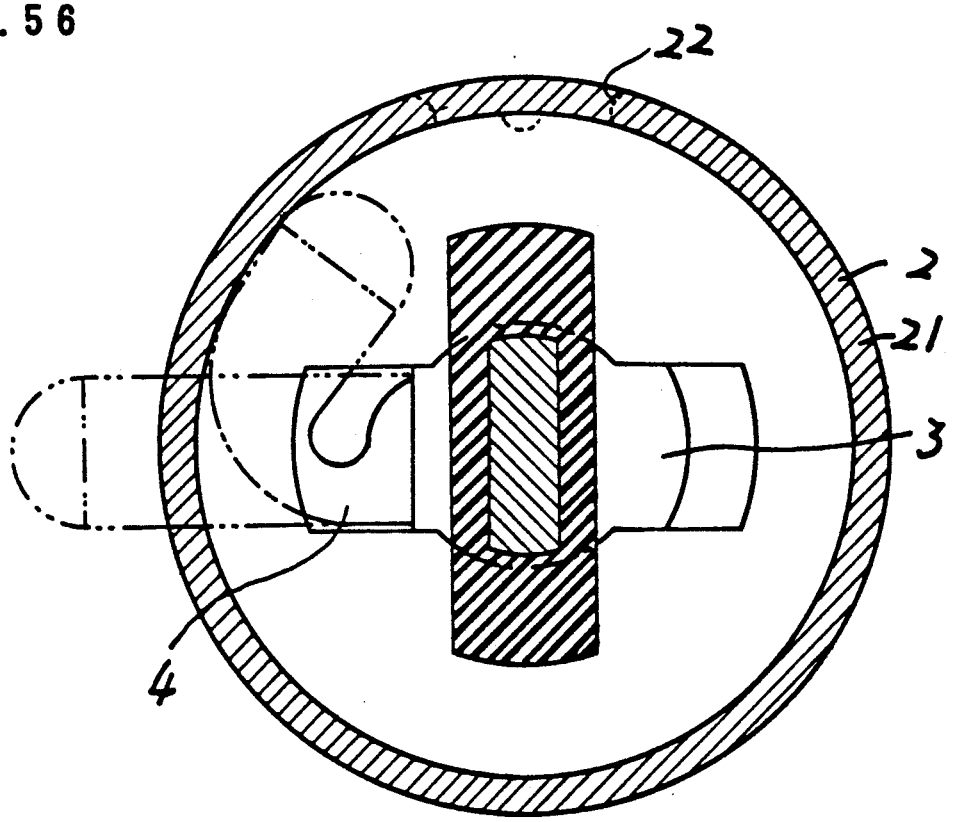
FIG. 56 is a lateral cross-sectional view of the same taken at line Y—Y.
Figure 57:
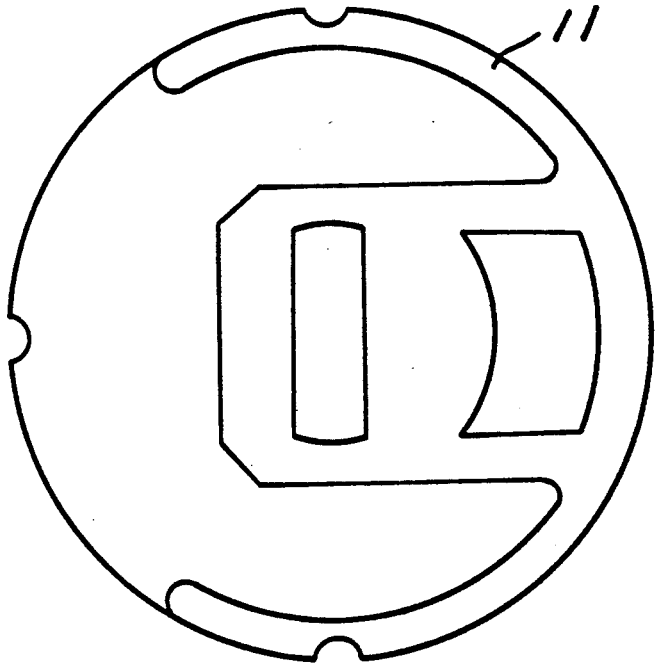
FIG. 57 is a plan view of the push button of the same embodiment.
Figure 59:
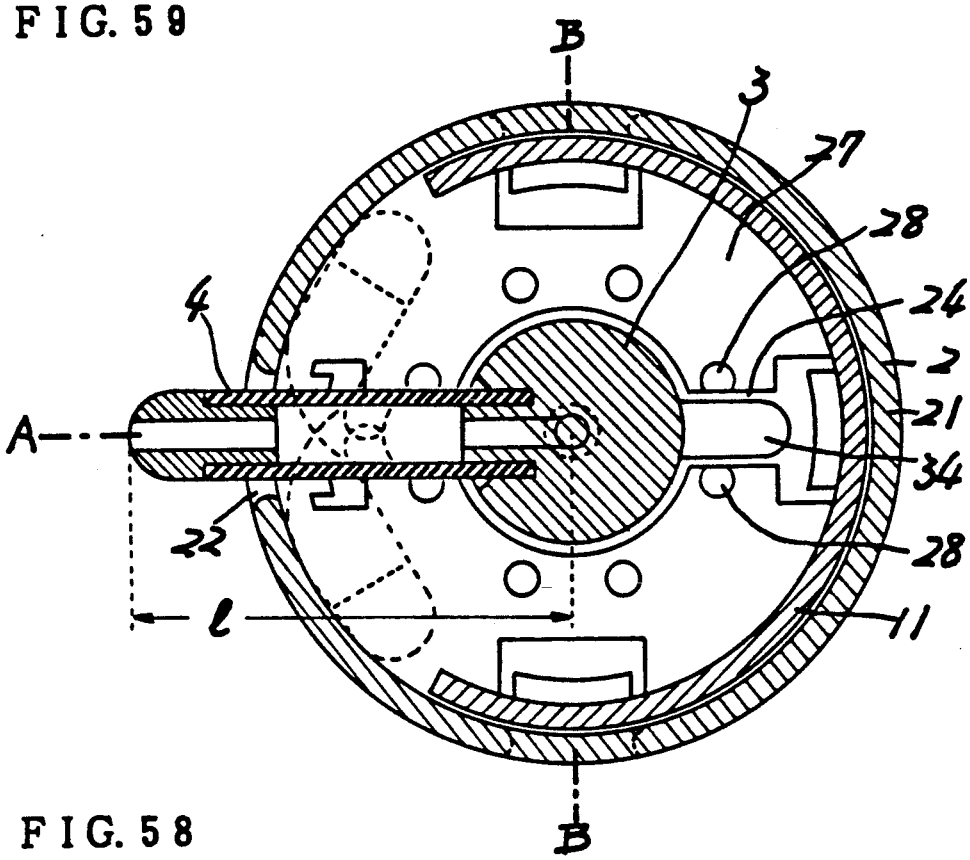
FIG. 59 is a lateral cross-sectional view taken at line X—X in FIG. 58.
Figure 58:
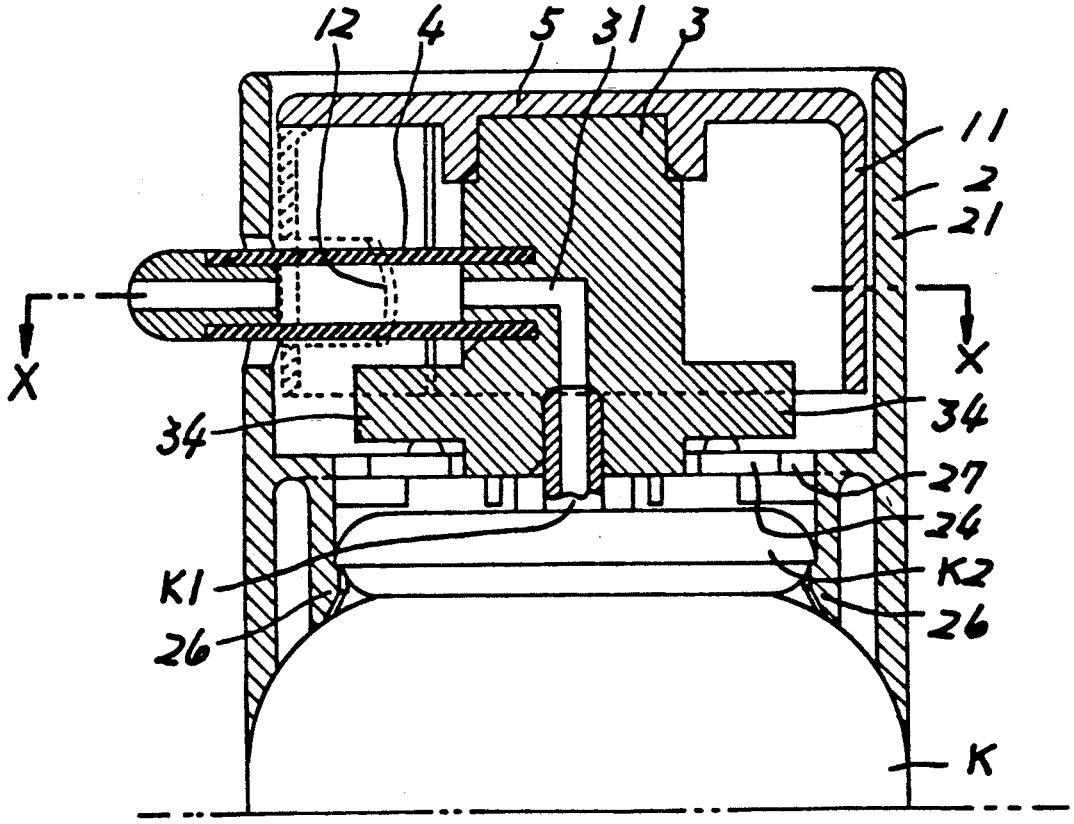
FIG. 58 is a vertical cross-sectional view of a twelfth embodiment in its operative position.
Figure 60:
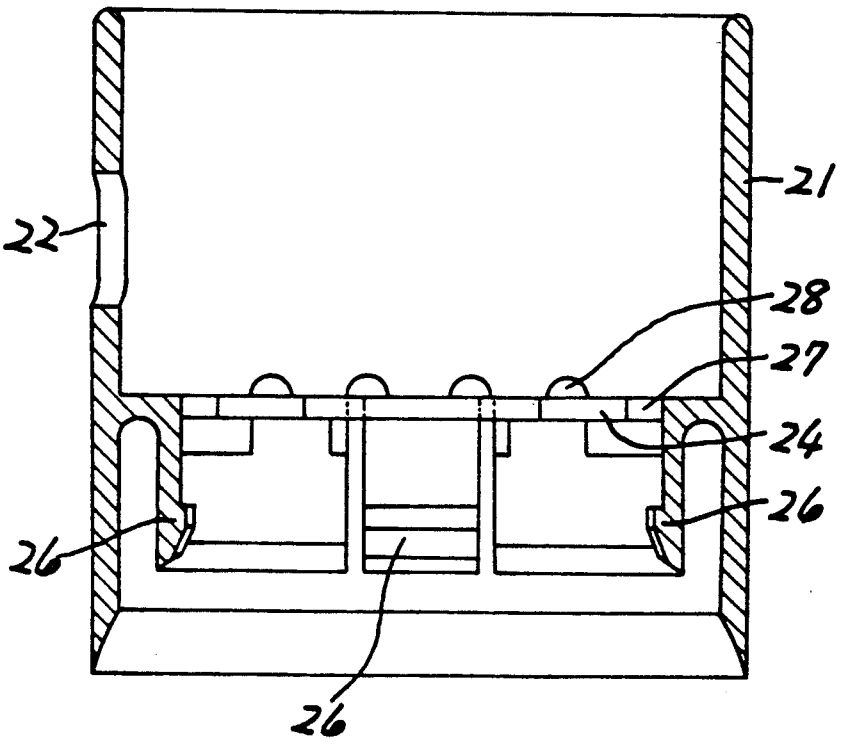
FIG. 60 is a vertical cross-sectional view of the rotary member of the same embodiment.
Figure 61:
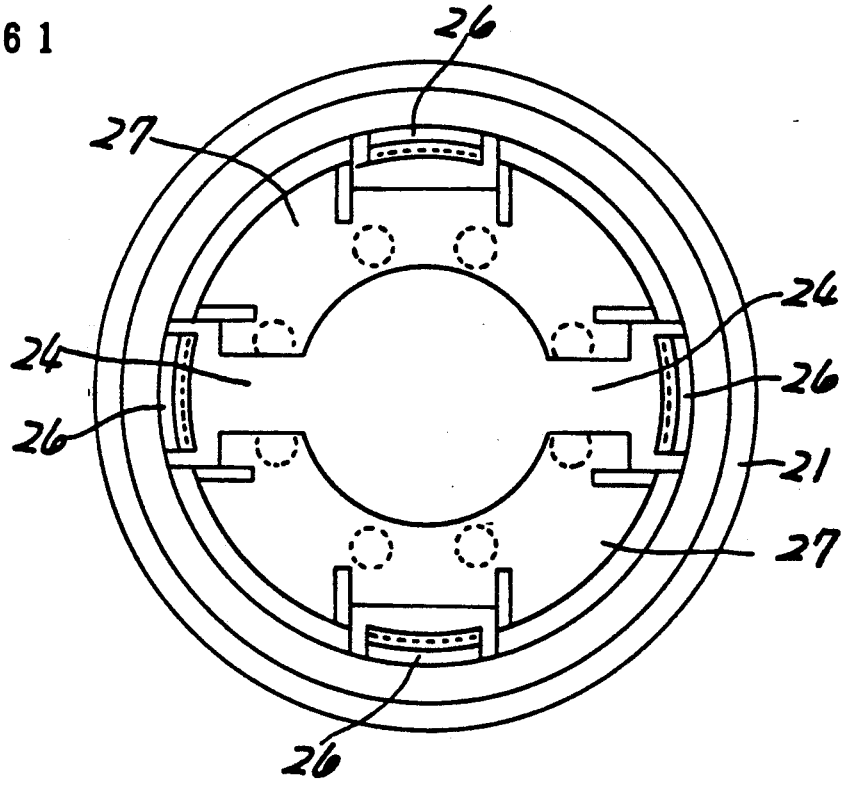
FIG. 61 is a bottom view of the same.
Figure 62:
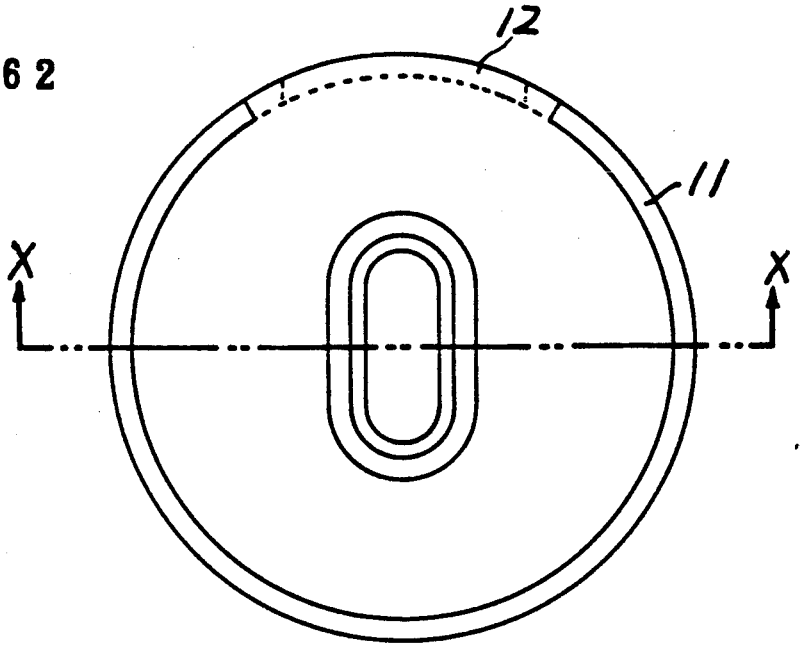
FIG. 62 is a bottom view of the push lid of the same embodiment.
Figure 63:
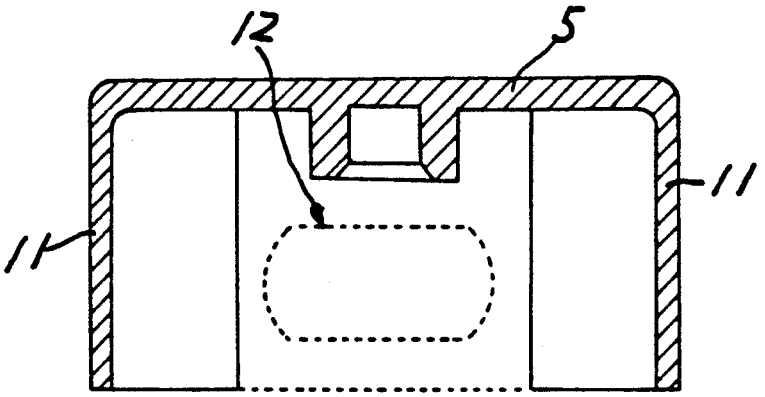
FIG. 63 is a vertical cross-sectional view taken at line X—X in FIG. 62.
Figure 64:
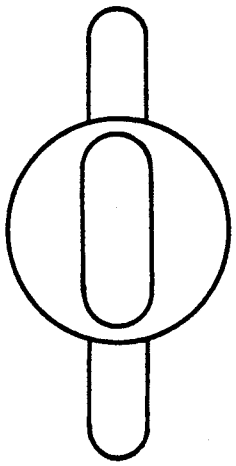
FIG. 64 is a plan view of the push button of the same embodiment.
Figure 65:
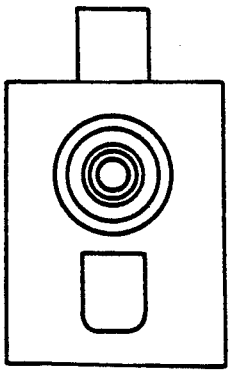
FIG. 65 is a front view of the same.
Figure 66:
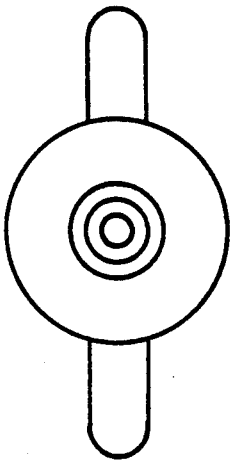
FIG. 66 is a bottom view of the same.
Figure 68:
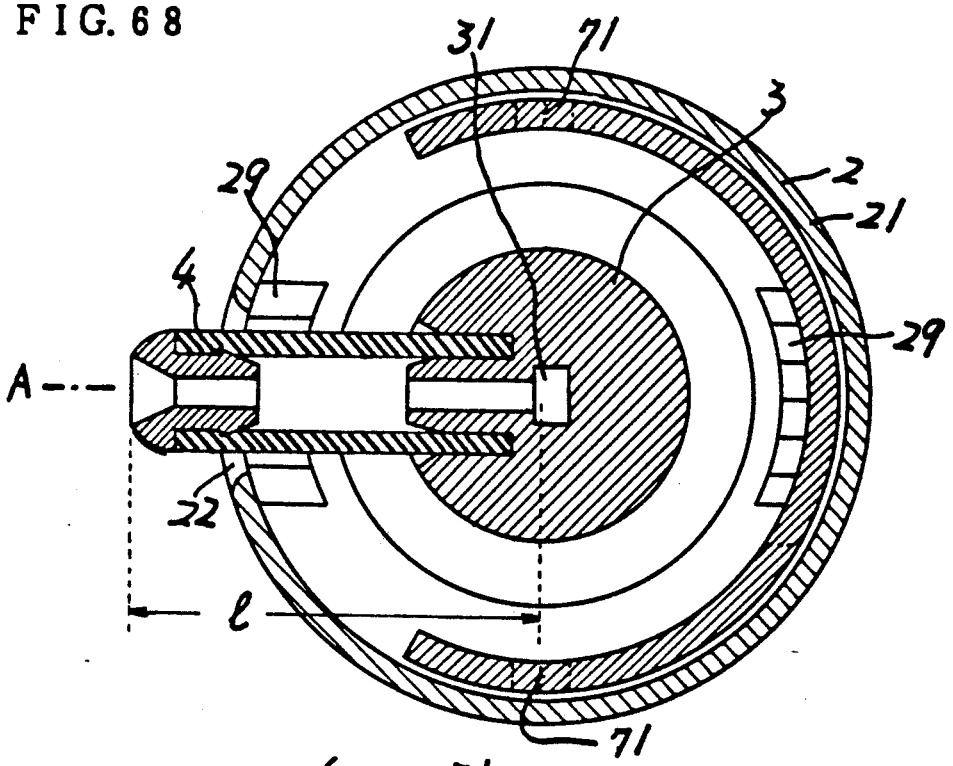
FIG. 68 is a lateral cross-sectional view taken at line X—X in FIG. 67.
Figure 67:
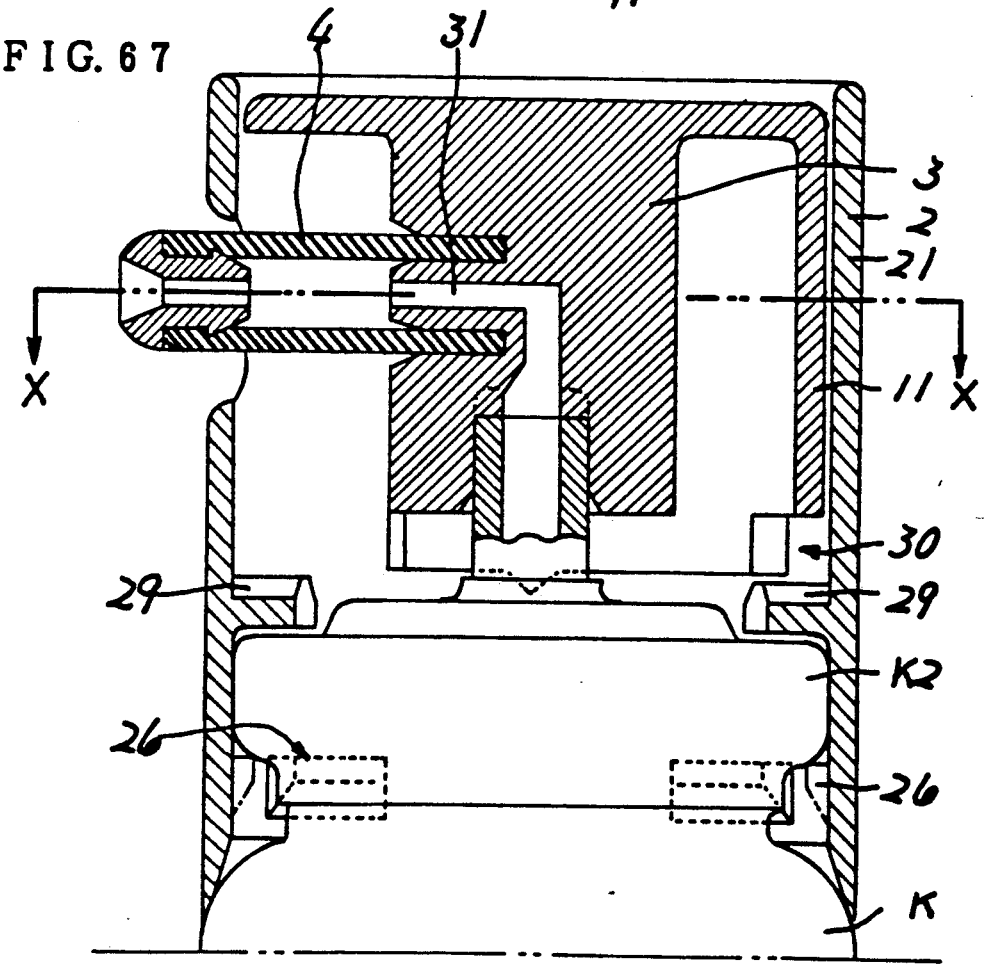
FIG. 67 is a vertical cross-sectional view of a thirteenth embodiment in its operative position.
Figure 70:
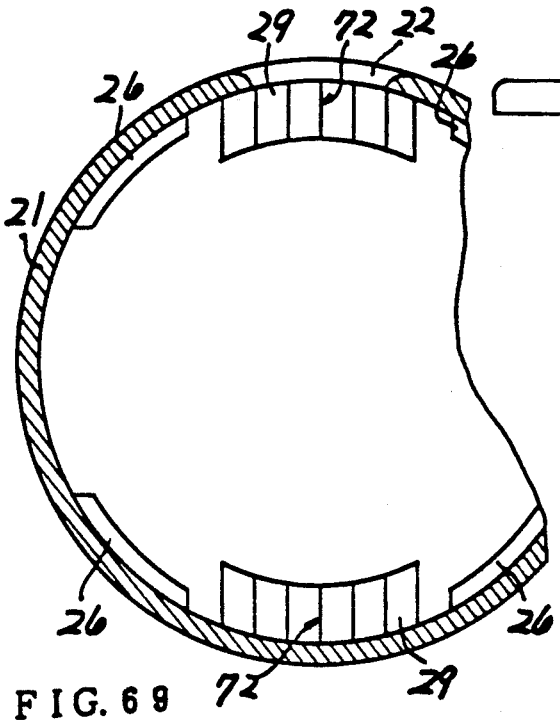
FIG. 70 is a lateral cross-sectional view taken at line X—X in FIG. 69.
Figure 71:
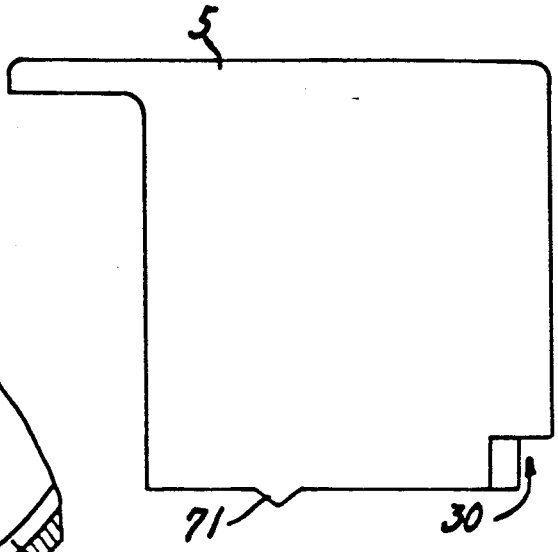
FIG. 71 is a right side elevational view of the push button of the same embodiment.
Figure 69:
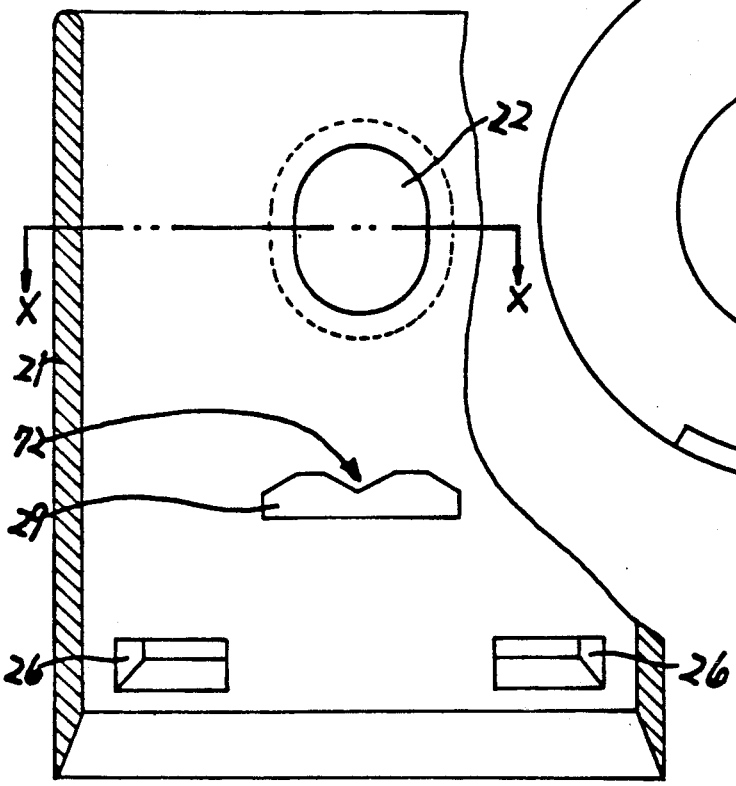
FIG. 69 is a vertical cross-sectional view of the main portion of the rotary member in the same embodiment.
Figure 72:
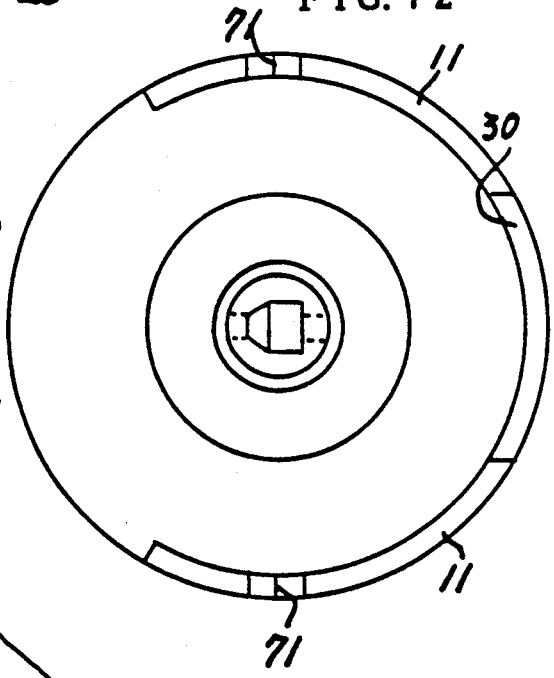
FIG. 72 is a bottom view of the same.

In FIGS. 45 and 46, the ninth embodiment is shown. In this embodiment, a large portion of nozzle tube 4 is made of a resilient straight tube. These Figures are shown in a mode at the non-operative position, and nozzle tube 4 in its bent mode is taken in within rotary member 2. However, upon recovering to the operative position along the arrow indicated in FIG. 46, it is obvious that the nozzle tube recovers to its straight mode by its own resiliency, so that the end of nozzle tube 4 can project out of window bore 22. Other structures in this embodiment are similar to, for example, those in the seventh embodiment.

FIGS. 47 to 53 show the tenth embodiment. Rotary member 2, nozzle tube 4 and push lid 5 are similar to those in the ninth embodiment. A long lateral projection 37 is formed at the top portion of push button 3 and non-rotatability of push button 3 is maintained by means of insertion of projection 37 into the laterally long guide bore 18 provided at the top wall 17 of non-rotary member 1. This guide bore 18 forms a keyhole portion against push plate 53 provided at the bottom face of push lid 5 so as to form a key member in this invention. Push plate 53 cannot go down in the non-operative position as shown, but rather in the operative position, because the longitudinal direction of push plate 53 is in accord with that of guide bore 18, engagement of push plate 53 and projection 37 of the push button becomes possible so that interlocking of push lid 5 and push button 3 can be made possible. That is, interlocking impeding means for push lid 5 and push button 3 at the non-operative position is formed by means of push plate 53 and top wall 17 provided with guide bore 18. Also, according to this embodiment, a plate projection 25 projects at a portion of the inner face of rotary member 2 so that, upon rotation of rotary member 2, this plate projection 25 may collide with stopper 19 provided at a portion of non-rotary member 1 and an excessive rotation of rotary member 2 can be impeded.

FIGS. 54 to 57 show .the eleventh embodiment of this invention. In this embodiment, nozzle tube 4, similar to the ninth and tenth embodiments, is made of a straight resilient tube such as a thick rubber tube. Accordingly, it is similar to that of the eighth embodiment which is shown in FIGS. 34 to 44 except it has a nature of self recovering from a bent mode.

Subsequently, FIGS. 58 to 66 show a twelfth embodiment of this invention. Push button 3 of this embodiment is mounted fixedly to valve stem K1 which is of non-rotatable nature, so it is also non-rotatable. Nozzle tube 4, similarly to one of those in the ninth to eleventh embodiments, is made of a straight resilient tube. Push lid 5, fixedly mounted to the push button, is provided with cylindrical wall 11 and performs the role of a non-rotary member in the foregoing embodiments. This cylindrical wall 11, similar to cylindrical wall 11 provided in push button 3 in the eighth and eleventh embodiments, is provided with a wide notch portion. However, cylindrical wall 11 can be a type of all around cylindrical wall provided with a notch 12 shaped in a long bore which is similar to that of the first embodiment of this invention. Cylindrical wall 21 of rotary member 2 is attached in a manner difficult to remove but rotatably to mounting cup K2 of dispensing container K. A shelf plate 27 provided with groove bore 24 which corresponds to a keyhole portion in this invention is adapted to short bars 34 projecting from push button 3 for key members in this invention. Such a keyhole portion and a key member form an interlocking impeding means for push lid 5 and push button 3 at the non-operative position. That is, referring to FIGS. 58 to 59 which are shown in the operative position, upon downward movement of push button 3 by means of push lid 5 being pushed down, groove bore 24 receives short bar 34 so that the push button can be lowered. However, upon rotation of rotary member 2, angular position of groove bore 24 changes so shelf plate 27 impedes interlocking of push lid 5 and push button 3. Further, small projections 28 formed on shelf plate 27 are provided for making setting of the relative angular position between rotary member 2 and short bars 24 easier.

Finally, FIGS. 67 to 72 show a thirteenth embodiment of this invention. Push button 3 in this embodiment, similar to the twelfth embodiment, is non-rotatable because it is fixedly mounted to non-rotatable valve stem K1. Nozzle tube 4, similar to the ninth to twelfth embodiments, is made of a straight resilient tube. Because push lid 5 is molded in one body with cylindrical wall 11, cylindrical wall 11 performs a role the same as that of cylindrical wall 11 in the twelfth embodiment and a wide notch portion is formed at its front portion. Rotary member 2, similar to that of the twelfth embodiment, is supported in a hard to remove manner but rotatable by mounting cup K2 by means of claws 26 provided at the skirt portion of cylindrical wall 21. There is formed projection edges 29 on the inner face of the front and rear portions of cylindrical wall 21. A notch 30 is formed at the skirt edge of cylindrical wall 11 so that projection edges 29 and notch 30 can form a relation of the key member and the keyhole means of this invention. There is provided a small projection 71 at the skirt edge of cylindrical wall 11 and a notch 72 on projection edges 29 so that stabilization of rotary member 2 at the non-operative position can be maintained.

As stated above, in a dispensing head according to this invention, change of position from a non-operative position to an operation position and from an operative position to a non-operative position are effected only by a twist of a rotary member which corresponds to a guard cap for the dispensing head, and as the nozzle tube projects out of the guard cap at the operative position, aim of emission can easily be secured. As the nozzle tube is taken in within the guard cap and, at the same time, the interior and the exterior of said guard cap is intercepted, not only is entry of filth or the like into the nozzle tube or the operation mechanism in the course of storage or transportation of dispensing containers prevented, but there is no danger of misemission caused by unexpected external forces. Furthermore, according to this invention, there is no danger of a malfunction occurring caused by loss of the guard cap because there is no need to remove the guard cap upon using the dispensing container. This invention provides a substantial contribution to improvement of aerosol dispensers and to enlargement of their utilizability in industry.

I claim:

1. A dispensing head having a guard cap which comprises:

a non-rotary member, a rotary member, a nozzle tube, and a push lid, each hereunder; said non-rotary member having a cylindrical wall provided with a wide notch portion and supported coaxially with and non-rotatably by a dispensing container containing, under pressure, an object for dispensing, and said non-rotary member having a push button hereunder; said rotary member having a cylindrical wall coaxial with said cylindrical wall of said non-rotary member, said cylindrical wall of said rotary member being provided with a window bore of a size comparable with the diameter of said nozzle tube and supported, by said dispensing container, rotatably and in external contact with said cylindrical wall of said non-rotary member, and said rotary member having a range of rotation which extends from an operative position in which said window bore is located at a location in front of said push button within an angular range of said notch portion of said cylindrical wall of said non-rotary member to a non-operative position in which said window bore is located at a location within an angular range of the solid portion of said cylindrical wall of said non-rotary member; said push button being provided with a dispensing passage connected to the axial bore of a valve stem projecting from the top portion of said dispensing container coaxially therewith and movable in a vertical direction to control a discharge valve provided in said dispensing container, and said push button being mounted fixedly on said valve stem and supported non-rotatably by said dispensing container; said nozzle tube being a solid and straight tube, the base portion of which is pivoted to the front portion of said push button and connected to said dispensing passage of said push button, and said nozzle tube having a nozzle length, as measured from the center of said push button, longer than the radius of said rotary member cylindrical wall; said push lid covering and closing substantially the top portion of said cylindrical wall of said rotary member and being supported movable in a vertical direction to be interlockable with said push button at least in said operative position; one of said non-rotary member or said rotary member being provided with a key member and the other one forming a keyhole portion adapted to said key member so that said key member and said keyhole portion can form an interlocking impeding means for said push lid and said push button in said non-operative position.

2. A dispensing head having guard cap means as claimed in claim 1, in which said non-rotary member is fixed to said dispensing container.

3. A dispensing head having guard cap means as claimed in claim 1, in which said non-rotary member is supported non-rotatably by said valve stem supported non-rotatably by said dispensing container.

4. A dispensing head having guard cap means as claimed in claim 1, in which said push lid is formed with a solid plate supported non-rotatably by said non-rotary member.

5. A dispensing head having guard cap means as claimed in claim 1, in which said push lid is a resilient plate supported non-rotatably by said rotary member at the peripheral edge portion of said push lid.

6. A dispensing head having guard cap means as claimed in claim 1, in which said rotary member forms said key member and said non-rotary member forms a keyhole portion adapted to said key member at said operative position.

7. A dispensing head having guard cap means as claimed in claim 1, in which said rotary member forms said key member and said non-rotary member forms a keyhole portion adapted to said key member at said non-operative position.

8. A dispensing head having guard cap means as claimed in claim 1, in which said non-rotary member forms said key member and said rotary member forms said keyhole portion adapted to said key member at said operative position.

* * * * *